US005425164A

United States Patent [19]

El Dessouky

[11] Patent Number: 5,425,164

[45] Date of Patent: Jun. 20, 1995

[54] HAND-TOOL SYSTEM FOR INSTALLING BLIND FASTENERS

[75] Inventor: Ahmed A. El Dessouky, Pico Rivera, Calif.

[73] Assignee: Textron Inc., Providence, R.I.

[21] Appl. No.: 115,429

[22] Filed: Sep. 1, 1993

[51] Int. Cl.[6] ..... B21J 15/20

[52] U.S. Cl. ..... 29/243.524; 72/453.16

[58] Field of Search ..... 72/453.16, 453.02; 29/243.521, 243.523, 243.524

[56] References Cited

U.S. PATENT DOCUMENTS

| | | | |
|---|---|---|---|
| Re. 31,957 | 7/1985 | Olsson . | |
| 3,082,898 | 3/1963 | Bosch . | |
| 3,115,752 | 12/1963 | Van Hecke . | |
| 3,374,656 | 3/1968 | Di Maio . | |
| 3,688,551 | 9/1972 | Alm . | |
| 3,713,321 | 1/1973 | La Pointe . | |
| 4,031,619 | 6/1977 | Gregory . | |
| 4,062,217 | 12/1977 | Ebbert et al. . | |
| 4,086,802 | 5/1978 | Ewig, Jr. . | |
| 4,116,036 | 9/1978 | Sheffield et al. . | |
| 4,248,077 | 2/1981 | Gregory | 29/243.524 |
| 4,263,801 | 4/1981 | Gregory . | |
| 4,310,056 | 1/1982 | Olsson . | |
| 4,339,942 | 7/1982 | Svensson | 72/453.02 |
| 4,365,401 | 12/1982 | Ogren . | |
| 4,462,240 | 7/1984 | Yamamoto | 29/243.524 |
| 4,470,280 | 9/1984 | Kelly | 72/453.02 |
| 4,497,197 | 2/1985 | Giardino et al. . | |
| 4,515,005 | 5/1985 | Klein . | |
| 4,580,435 | 4/1986 | Port et al. . | |
| 4,587,829 | 5/1986 | Sukharevsky . | |
| 4,597,263 | 7/1986 | Corbett . | |
| 4,628,722 | 12/1986 | Mauer et al. . | |
| 4,630,460 | 12/1986 | Mauer . | |
| 4,750,347 | 6/1988 | Saarinen . | |
| 5,031,508 | 7/1991 | Babyak . | |

*Primary Examiner*—David Jones

[57] ABSTRACT

A light-weight and compact hand actuated hydraulic tool for the setting of fasteners having a sleeve and stem is disclosed. The tool comprises a housing, sleeve engaging nose piece connected to a piston which is slidable in the housing, a fluid reservoir, hand-operated pump lines, and a drawbolt which has stem gripping jaws connected thereto. The stem of a fastener is gripped by the jaws, and the sleeve of the fastener is engaged by the nose piece. In an initial stage, a pump plunger compresses liquid in first and second chambers into a piston chamber, which affects movement of the housing and drawbolt in relation to the piston, pulling the stem in relation to the sleeve. As the pulling force increases, and thus the necessary hand pumping force, pressure in the piston chamber opens a valve, allowing fluid in the first chamber to return to the reservoir so that only the second plunger chamber is used to compress the liquid into the piston pressure chamber, lessening the force necessary to actuate the pump lever. In one arrangement, a pilot piston that opens the valve includes an internal relief valve that allows liquid in the piston chamber to return to the reservoir in response to predetermined maximum piston chamber pressure or in response to manual pressure.

39 Claims, 15 Drawing Sheets

HAND-TOOL SYSTEM FOR INSTALLING BLIND FASTENERS

FIELD OF THE INVENTION

The present invention relates to tools used to install fasteners which are accessible from only one side, often called blind rivets. More specifically, the present invention relates to a lightweight and compact hand-operated tool which uses a hydraulically powered piston to pull the stem of a blind rivet through a sleeve, whereby the fastener is set in a workpiece.

BACKGROUND OF THE INVENTION

Blind rivets or fasteners are of the type in which only one side of the workpiece is accessible. In such fasteners, a stem and fastener body or sleeve are inserted as a unit into aligned openings in workpieces. The sleeve typically has a tail which engages the blind side of the workpieces and a head which engages the side of the workpieces which is accessible. A stem tail extending beyond the sleeve head is pulled from the accessible side of the sleeve causing a head on the stem, protruding beyond the sleeve tail to be drawn against the sleeve tail to deform it and create a head on the blind side of the workpieces. Once the sleeve has deformed, the workpieces are secured together, sandwiched between the head of the sleeve on the accessible side of the workpieces and the deformed head created on the blind side of the workpieces. Further pulling on the stem tail causes the stem to break at a predetermined location near the head of the sleeve, allowing removal of the excess stem portion protruding from the sleeve.

Many types of tools have been developed prior to this time for grasping a stem and pulling it through a sleeve to set a fastener. These tools have included pneumatic-hydraulic and hydraulically powered tools which use a piston to pull the stem of the fastener.

Many of these tools have suffered from the limitation that they required a secondary source of hydraulic or pneumatic pressure to power the piston. Such a requirement adds to the cost and complexity of such equipment. Further, when a secondary source of hydraulic or pneumatic pressure is required, the tool is not portable. The requirement that the secondary hydraulic or pneumatic source be attached to the tool during use prevents the tool from being used in many difficult to reach areas, as hoses and cords must be run from the secondary source to the tool. More commonly, the power source is not even available in repair situations.

Several hand powered tools have been developed for setting fasteners. These tools typically use a hydraulically operated piston to pull the rivet stem as well. Such tools, however, utilize the action of a hand pumped lever to create the hydraulic pressure necessary to move the piston. One such hand operated tool is disclosed in U.S. Pat. No. 4,263,801 to Gregory. This patent discloses a hand tool having a cylinder which has a piston located partially therein. The piston has a lateral bore with an intake port on one end and an exhaust port on the other, as well as a transfer chamber which is connected to a pressure chamber. A pump bore in the rear of the piston contains a plunger and opens into an inlet chamber. In order to operate the tool, a stem is inserted into one end of the piston, and the plunger is squeezed to force fluid from a reservoir into the inlet chamber and through the piston into the pressure chamber. The fluid pressure causes the piston to move away from a nose piece which is fixed to the cylinder and engages the sleeve. As the pressure in the pressure chamber increases, the piston is forced further away from the nose piece, at the same time pulling the stem through the sleeve, setting the fastener.

Several problems exist with the prior art hand powered fastener setting tools such as that described above. First, these tools have often been bulky and heavy, as dictated by the requirement that there be a mechanism by which sufficiently high hydraulic pressure may be generated so as to pull the stem. Second, the force necessary to actuate the pump or squeeze lever is often so high that it is not possible for a normal person to operate the tool in high pressure applications, or if it can be so operated, fatigue does not allow the tool to be maintained for use in setting many fasteners. This problem is caused by the fact that the ultimate upsetting force required to pull the stem, as well as the breaking strength of the stem, which the piston must apply to the stem, must be generated by pumping a handle to create high pressure fluid.

High pulling forces can be generated with only small squeezing or pumping forces, but there are adverse effects, that is, a tool with a small effective area about which the force is distributed requires only a small pumping force by an operator. At the same time, however, in such a device, each pump of the lever creates only a very small increment of fluid displacement, and thus piston movement. Thus, the lever must be squeezed many times to obtain the full piston stroke necessary to set the fastener. The high number of strokes which are necessary to set the fastener is inefficient from the standpoint that it takes a long time for the fastener to be set, and from the standpoint that it takes a great deal of operator energy to set each fastener.

Prior art fastener setting tools thus have not fulfilled the need for a hand operated tool which is light weight and compact, and which generates high pulling forces with low squeezing or pumping force, and at the same time is efficient to operate.

SUMMARY OF THE INVENTION

In order to overcome the above stated problems and limitations, there is provided an improved hand-operated, hydraulically powered tool for installing blind rivets.

In general, the tool comprises a housing, a fastener sleeve engaging member or anvil, a piston slidable within the housing, a drawbolt connected to a fastener stem gripping means, and a plunger mechanism for pumping and compressing fluid from a reservoir.

The stem of the fastener is pulled through the sleeve as fluid is compressed into a piston pressure chamber, causing the piston to move in relation to the housing. Fluid is compressed into the pressure chamber in a first stage, low pressure mode utilizing first and second pump pressure chambers. During this stage, the fluid in the first and second pump pressure chambers is pressed upon by the plunger, forcing the fluid into the piston pressure chamber to react against the piston and the housing, in a manner to cause pulling of the stem in relation to the sleeve. Because both the pump pressure chambers are utilized to compress the fluid into a piston pressure chamber in the first stage, relatively large movement of the piston in relation to the housing occurs with each stroke of the plunger. During this stage, only a lower level of pressure is established in the piston chamber, and initially only a low level of force is necessary to be applied by the user to the lever connected to the plunger to cause this effect.

The pump is connected to a second stage or high pressure mode after the force necessary to move the stem, and thus the hydraulic pressure required to do the same, has increased to a point at which squeezing of the lever connected to the plunger becomes difficult.

More specifically, during the second stage or high pressure mode, the fluid pressure in the piston pressure chamber becomes high enough to automatically open a bypass valve causing any fluid pressure in the first pump chamber to be returned to a reservoir. Further pumping of the plunger at this time causes fluid to be compressed only from the second pump pressure chamber into the piston pressure chamber. Because the effective area of the plunger which is being used to compress the fluid into the piston pressure chamber during the second stage is less than that used during the first stage, the amount of force which must be applied to the plunger, and thus the hand lever, at this time, is less than that which would be necessary if both pressure chambers were still being utilized. Of course, the pump handle lever force requirement increases in the high pressure mode as the pressure in the piston chamber increases.

Once the stem has been pulled to the point at which the fastener has been set and the stem has broken off, a manual relief means may be operated for relieving the pressure in the system, to ready the tool for setting another fastener.

A safety relief means is also provided for automatically relieving excessively high pressure in the system, including the piston pressure chamber. This safety relief means includes a bypass valve which opens to allow fluid to return to the reservoir.

In a preferred embodiment of the tool of the present invention, the second stage bypass means, the manual relief means and the safety relief means are all included in a single assembly. This assembly permits all three systems to be located in a single small space thus reducing the size of the tool. Further the systems are integrated in this assembly thus reducing the number of parts necessary to accomplish each function, and reducing the cost and difficulty of manufacturing the tool.

These and other aspects of the invention will become apparent from a study of the following description in which reference is directed to the following drawings.

DESCRIPTION OF THE DRAWINGS

FIG. 7 is a cross-sectional side view of the tool in FIG. 6, illustrating the tool after completion of the setting of a fastener.

FIG. 1 is a cross-sectional view of the tool of FIG. 8 taken along line A—A illustrating the tool when the manual relief plunger is depressed.

DETAILED DESCRIPTION OF THE PREFERRED EMBODIMENT

Figure 1:
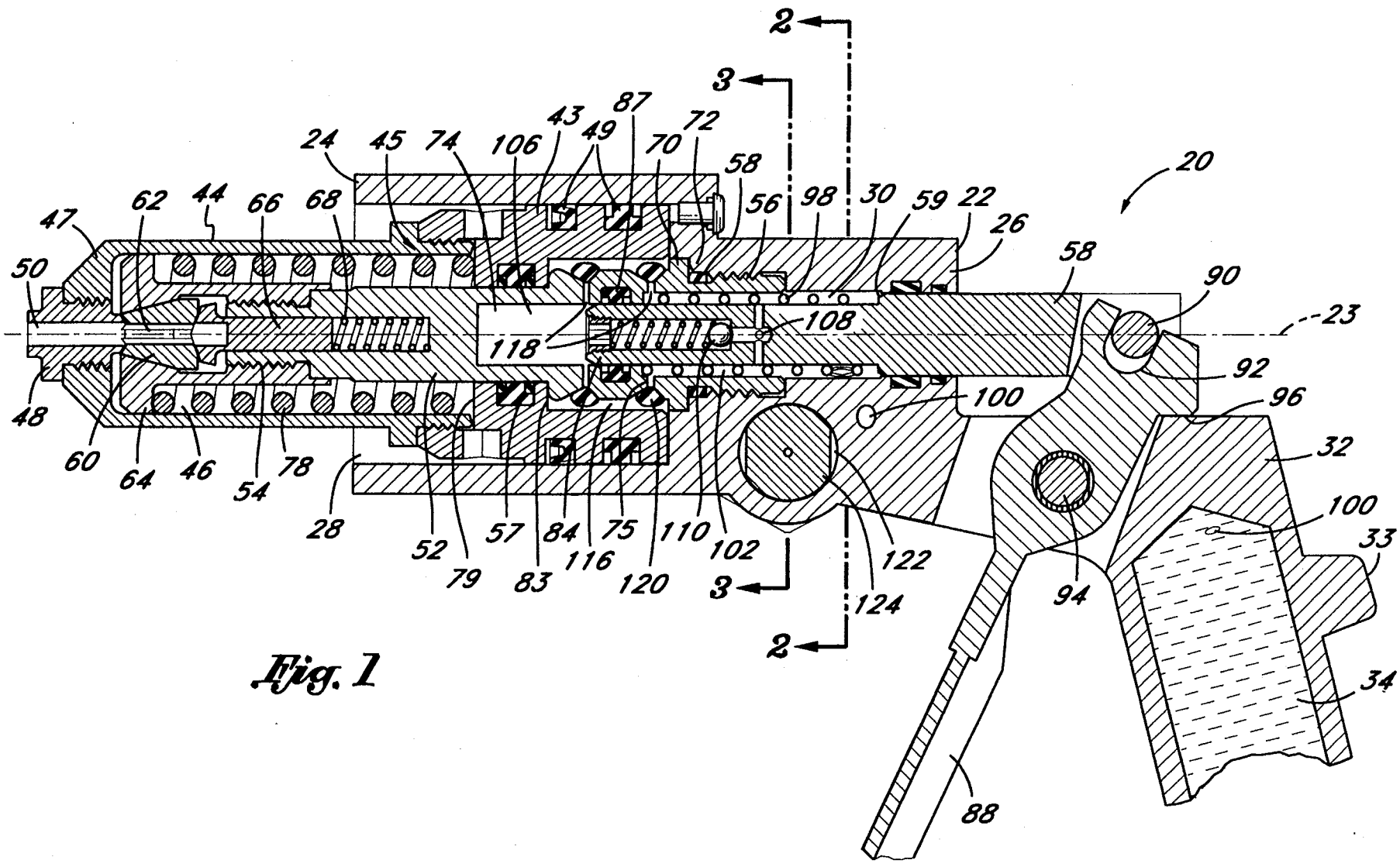
FIG. 1 is a cross-sectional side view of a tool of the present invention taken along the centerline of a housing, plunger, and piston of the tool.

FIG. 1 illustrates a hand operated tool 20 for setting fasteners, in accordance with the present invention. As illustrated, the tool 20 includes a substantially cylindrical housing 22 having a centerline 23, a forward open end 24 and a rear closed end 26. Preferably, the housing 22 is constructed of steel or aluminum, so as to employ thin lightweight walls that are yet strong and durable. Preferably, the housing 22 is only about 3 inches long and has a largest diameter of about 1.7 inches. A large bore 28, preferably having a diameter of about 1.4 inches, extends inwardly from the open end 24 of the housing 22 along the centerline, preferably about 1.6 inches. A small bore 30 passes from the end of the large bore 28 through to the closed end 26 of the housing 22 along the centerline.

A handle 32 extends from a lower portion of the closed end 26 of the housing 22. Preferably, this handle 32 is constructed as part of the housing 22, although it is possible to attach a separately formed handle. The handle 32 is preferably approximately 4.5 inches long and 1.1 inches in diameter, so that it may easily be placed against the palm of a hand. The outer surface of the handle 32 may be knurled or have one or more hubs 33 located thereon to facilitate easier gripping.

A reservoir 34 is located within the handle 32. The reservoir 34 may be of any shape, but preferably it is cylindrical and extends from the lower end of the handle 32 opposite the housing 22, into the upper end of the handle.

Figure 6:
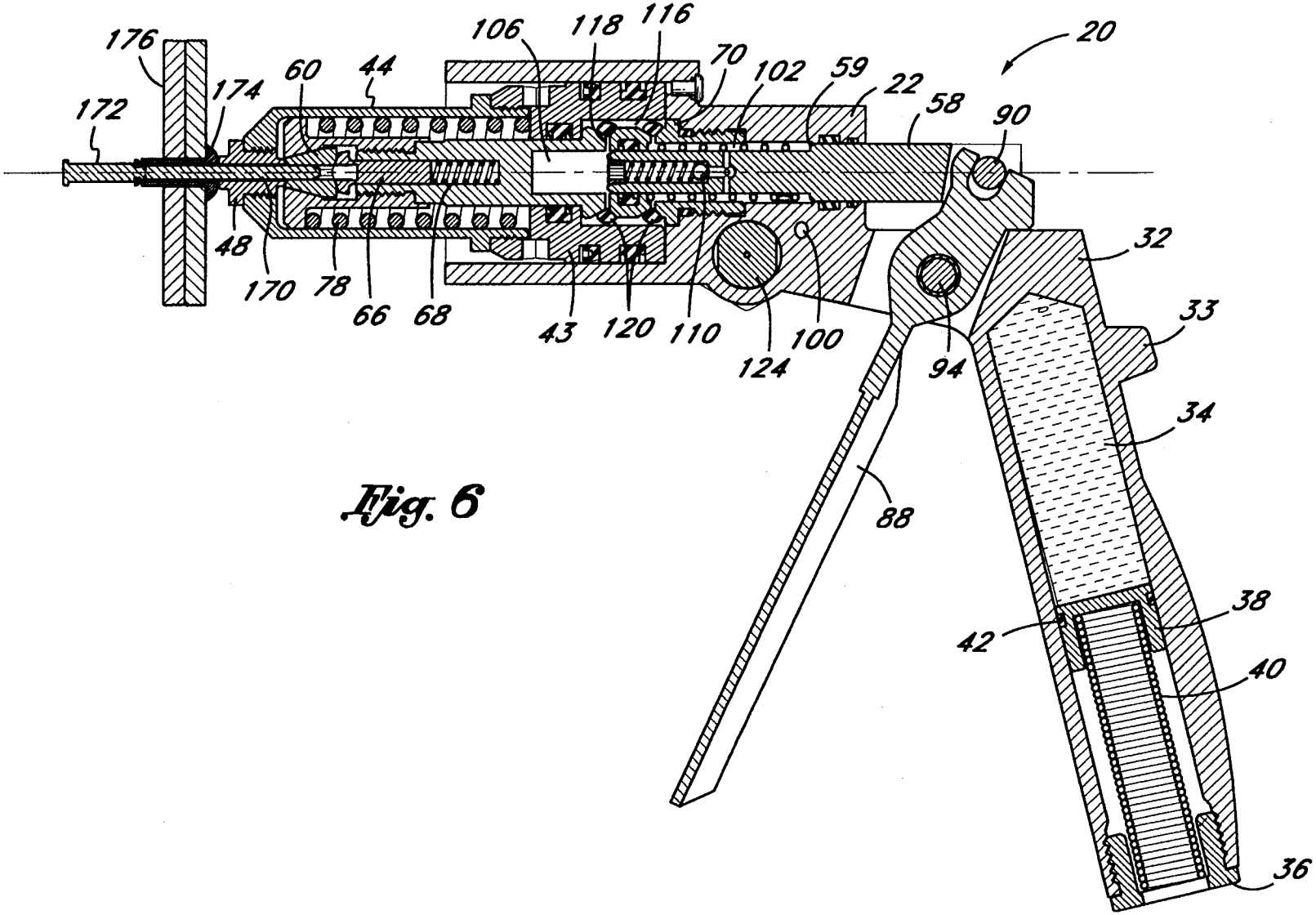
FIG. 6 is a cross-sectional side view of a tool of the present invention taken along the centerline of the tool as in FIG. 1, illustrating the tool after initial engagement with a fastener.
Figure 2:
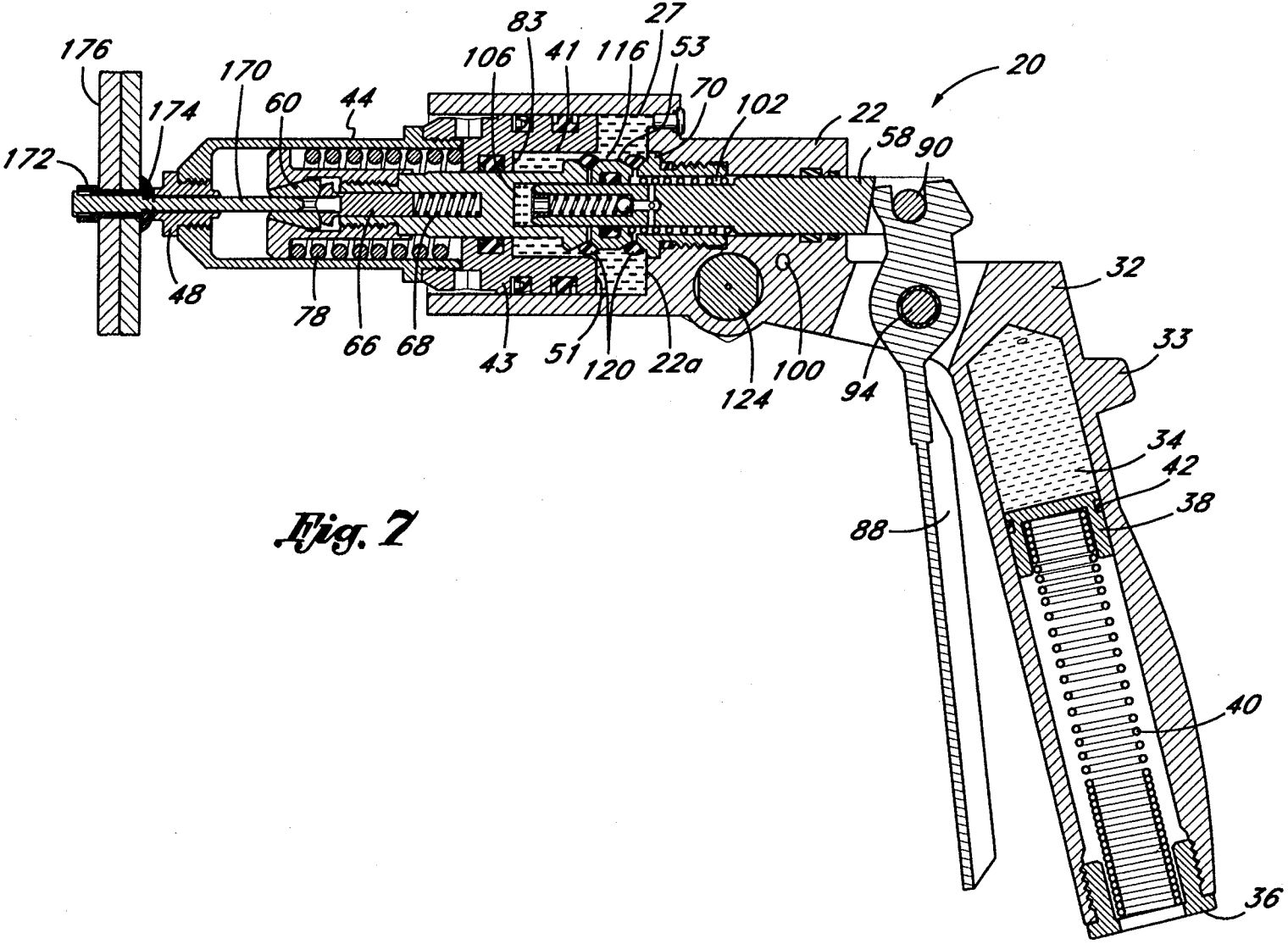

Referring now to FIG. 6, so that fluid may be placed in the reservoir 34 and contained therein, a tubular plug 36 is positioned in the end of the handle 22, preferably by a threaded arrangement. A ram 38 is located in the reservoir 34 and a seal 42 located on the ram 38 prevents liquid leaking from the reservoir side of the ram 38 to the atmospheric side. A spring 40 extending between the plug 36 and ram 38 biases the ram 38 upwardly in the reservoir 34, whereby any fluid in the reservoir 34 is compressed toward the top of the reservoir 34.

Referring again to FIG. 1, a short cylindrical, main piston 43 is slidably located within the large bore 28 of the housing 22. A pair of sealing rings 49 are located on the outside of the piston 43 between the piston 43 and housing 22, so as to prevent hydraulic fluid from passing between the piston 43 and housing 22.

A nose piece 44 or other sleeve engaging element has a rear end 45 threadably connected to the forward end of the piston 43, and a forward end 47 protruding from the housing open end 24. The nose piece 44 is primarily cylindrical on its outside surface, and has a center hollow bore 46 extending entirely therethrough. The nose piece 44 is preferably constructed of steel or aluminum and attached to the piston 43 after the insertion of a drawbolt 52 and spring 78.

A tubular anvil 48 which may be considered a part of the nosepiece is threaded into the forward end 47 of the nose piece 44 outside of the housing 22. The anvil 48 is preferably flat on its forward face for engaging the sleeve head of the fastener. A central bore 50 extends through the anvil 48 to receive a fastener stem.

The generally cylindrical drawbolt 52 extends from within the nose piece 44 through the piston 43, and the housing 22, to the small bore 30 in the housing 22. The rear end 56 is threaded into the housing 22. An outwardly extending flange 70 located on the rear end 56 of the drawbolt 52 engages the housing 22 at an annular ledge 72 located within the small bore 30 in the housing. An O-ring seal 58 adjacent the flange 70 prevents leakage in that area. A sealing ring 67 in the forward end of the piston 43 engages the drawbolt to prevent leakage in that area.

Suitable stem gripping means 60 is located at the forward end 54 of the drawbolt 52, including two or more jaws defining a central hole 62 into which a fastener stem may be inserted and gripped securely. The jaws 60 are captured within the forward end of a tubular collet 64 having a rear end threaded on the forward end of the drawbolt 52.

A pin 66 located within a counterbore in the end 65 of the drawbolt 52, is biased forwardly against the jaws 60 by a spring 68 located in a bore in the drawbolt 52, extending between the end of the bore and the pin 66. In this fashion, the pin 66 forces forward tapered surfaces on the jaws 60 against an inner conical, oppositely tapered, portion of the collet 64, whereby the jaws 60 are biased radially inwardly into a closed position about a stem inserted therein. It is also noted that for stability, the forward end of the pin 66 has a socket in which the forward end of a fastener.

A large coil spring 78 surrounds the forward end 54 of the drawbolt 52, extending between a forward face 79 of the piston 43 and an outwardly extending flange on the forward end of the collet 64. The spring thus urges the piston 43 rearwardly in the housing and urges the drawbolt and housing forwardly.

An elongated cylindrical bore 74 extends from the rear 56 of the drawbolt 52 to about half way into the drawbolt.

A plunger 58 has a relatively small diameter forward end 84 located within a correspondingly small diameter portion of the bore 74 in the rear of the drawbolt 52. The plunger has a larger diameter rear end which slides within a larger diameter section of the drawbolt bore, and includes a portion extending out of the housing near the handle 32. The plunger 58 is preferably a primarily cylindrical shaft of aluminum or steel which is located along the centerline of the housing 22. A sealing ring 87 is located in an annular in the drawbolt 52 and engages the plunger 58 so as to prevent fluid leakage along the plunger 58.

A lever 88 easily grippable with the fingers of one hand, is connected to the rear of the plunger 58. The lever 88 is preferably connected to the plunger 58 by a drive pin 90 located on the plunger 58 by a saddle 92 on the end of the lever 88. The lever 88 is pivotably mounted on a pivot pin 94 mounted on the housing 22 near the handle 32. In this fashion, the lever 88 pivots about the pin 94, and causes the pin 90 to reciprocate the plunger 58 along the housing axis 23. A stop 96 preferably located on the lever 88 near the saddle 92 engages the housing 22 so as to limit the range of motion of the lever 88 and thus the plunger 58.

As illustrated in FIG. 1, a coil spring 98 extends between an annular shoulder 59 marking the large diameter section of the plunger 58 and an annular shoulder 75 at the start of reduced diameter section of the bore 74 in the drawbolt 52. In this manner, spring 98 biases the plunger 58 rearwardly relative to the closed end 26 of the housing 22.

Figure 2:
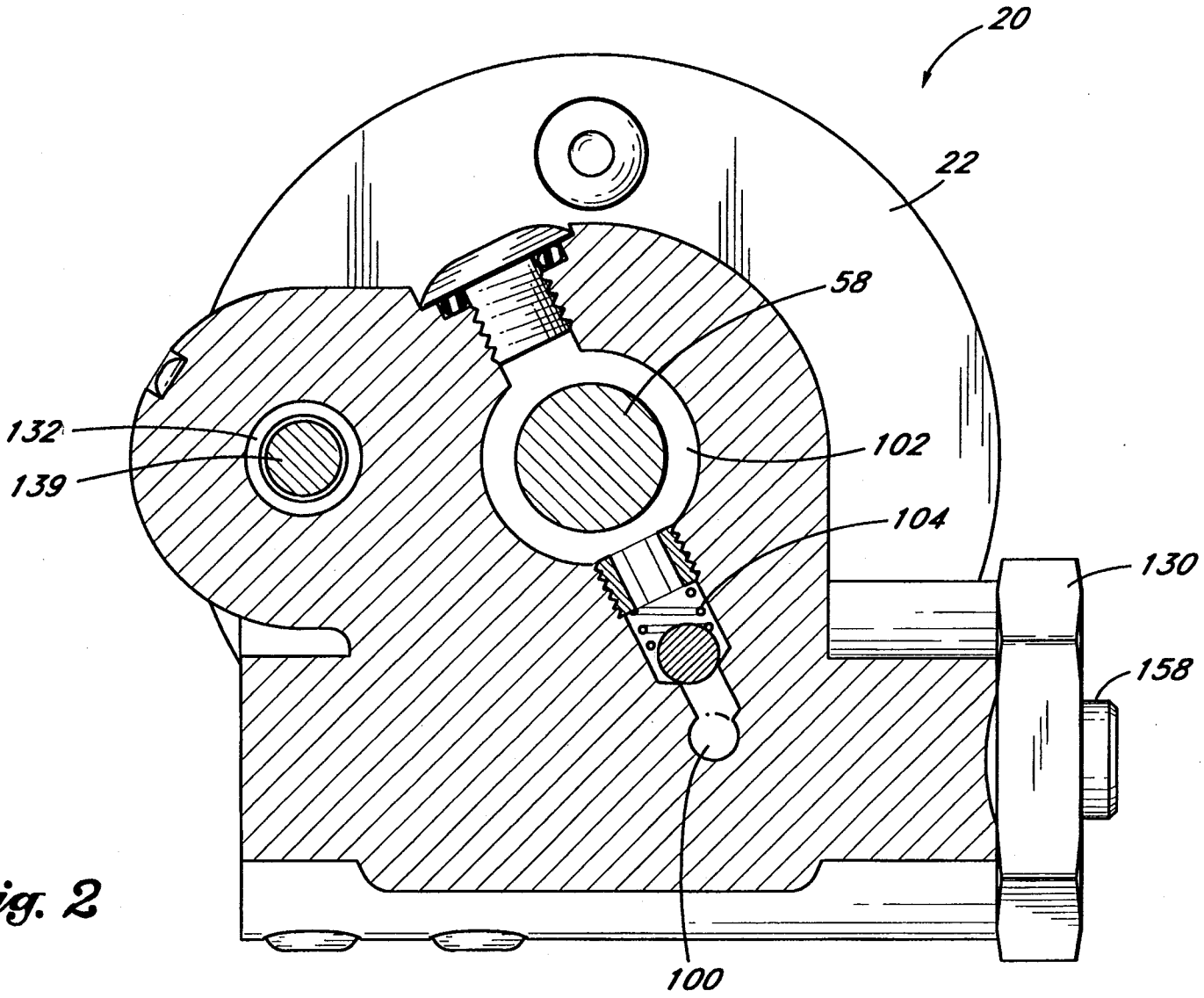
FIG. 2 is a cross-sectional view of the tool illustrated in FIG. 1, taken along line 2—2 of FIG. 1.

In order that the tool 20 be hydraulically operated, a number of passages and chambers are connected to the reservoir 34. A first passage 100 extends from the top of the reservoir 34 in the handle 32 through the handle 32 and housing 22 to a first pump pressure chamber 102. This passage 100, at its intersection with the chamber 102, may be drilled into the housing 22, and be sealed with a plug, as illustrated in FIG. 2. The first pressure chamber 102 is defined by the large diameter portion of bore 74 in the drawbolt 52, the bore 30 in the housing 22, the plunger shoulder 59, and the drawbolt shoulder 75. The spring 98 is confined within the chamber 102. As best illustrated in FIG. 2, a one-way adjustable check valve 104 is located in the passage 100 near its connection to the first pressure chamber 102. The check valve 104 is oriented to allow fluid to pass from the reservoir 34 to the first pressure chamber 102, but not allow flow in a reverse direction.

A second pump pressure chamber 106 connected to the first pressure chamber 102 is defined by the internal end 84 of the plunger 58 and the end of the bore 74 in the drawbolt 52. A tubular internal end 84 of the plunger 58 forms a passage 108 which connects the pump pressure chambers 102 and 106, by way of one or more radial passage. A check valve 110 is located in the passage 108 and is oriented to allow flow of fluid only from the first chamber 102 to the second chamber 106. Preferably, this check valve 110 comprises a ball urged by a coil spring held in place by a tubular plug threaded into the plunger.

The orientation of the check valves 104, 110 allows fluid located in the reservoir 34 to be drawn in one direction through passage 100 and check valve 104, into the first pump chamber 102. Fluid may then also pass from the first pressure chamber 102 to the second pump chamber 106, in one direction through check valve 110 and passage 108.

A piston pressure chamber 116 is defined on ends by the annular piston shoulder 83, and the flange 70 on the drawbolt 52 when closed as shown in FIG. 1, and also on the ends by the annular rear face 51 of the piston 43 and the annular end wall 22*a* of the housing, when the piston has moved, as shown in FIG. 7. The chamber 116 is defined on cylindrical sides by the drawbolt wall 53, the piston wall 41 and the housing wall 27, as seen in FIG. 7. The piston pressure chamber 116 is connected to the first pump chambers 102 and 106 by radial passages 118 (FIG. 1) through the drawbolt. A resilient ring 120 is located within the third chamber 116 on the exterior of the drawbolt 52 where each passage 118 exits into the third chamber 116. The rings 120 act as check valves permitting pressurized liquid flow into the piston pressure chamber 116, while preventing reverse flow.

Figure 3:
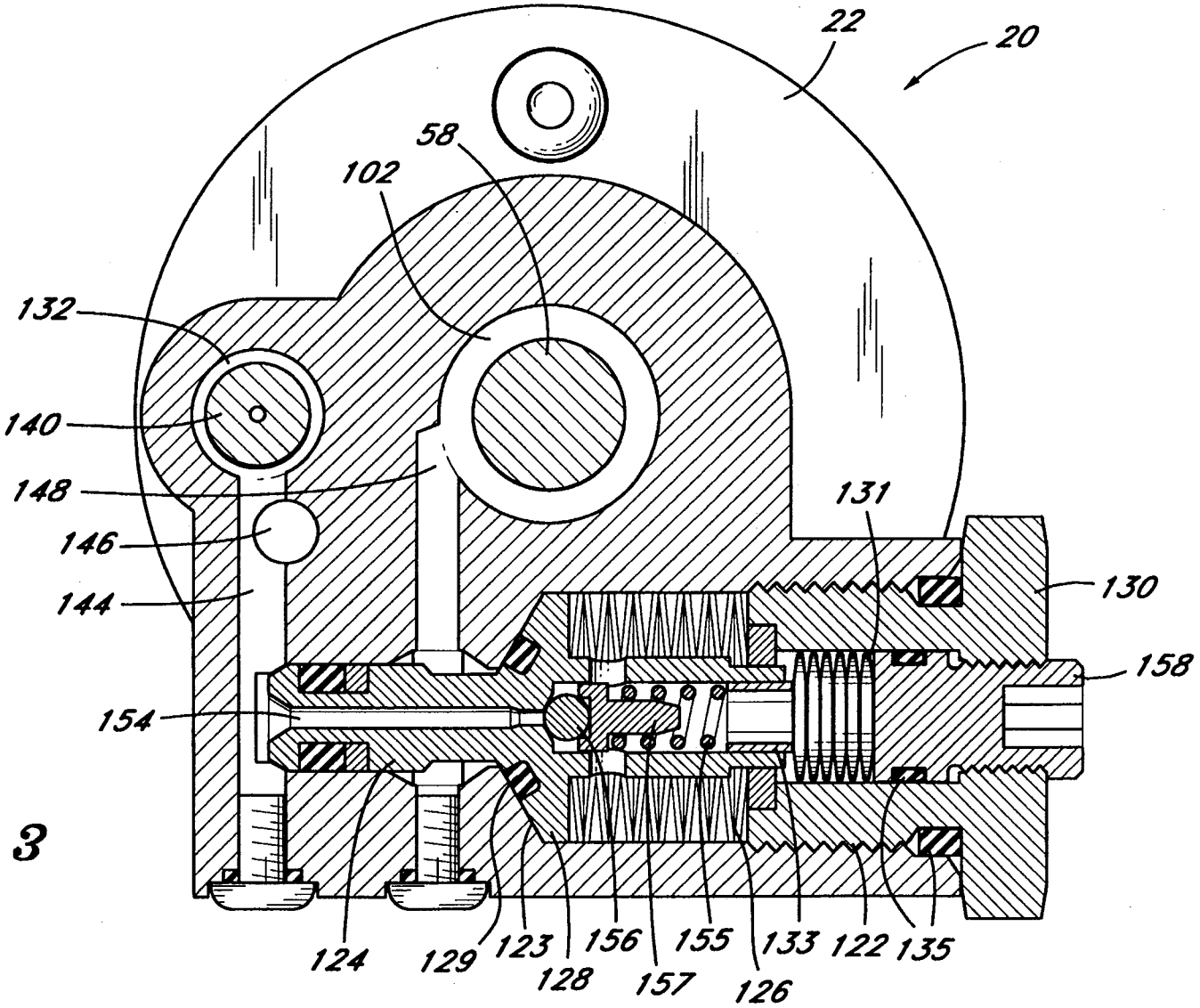
FIG. 3 is a cross-sectional view of the tool illustrated in FIG. 1, taken along line 3—3 of FIG. 1.

In accordance with the invention, a system is provided for attaining high pressure in chamber 116 with reduced force required to actuate the plunger 58. More specifically, there is provided means for automatically converting the tool from a low pressure mode to a high pressure mode bypassing back to the reservoir the hydraulic pressure which is developed in the first pressure chamber 102. As illustrated in FIG. 3, this system includes a bore 122 located in the housing 22, with its longitudinal axis perpendicular to the centerline 23 of the housing 22, and to the rear of the large diameter bore portion of the housing. Further, the bore 122 is located below the plunger 58 and thus does not add to the length of the tool. The bore 122 preferably passes from one side of the housing 22 to a point near the other side of the housing 22, and does not add appreciably to the diameter of the tool. Preferably, the bore 122 has an outer large diameter section, and a tapered section leading to a smaller diameter section.

The converting means includes bypass piston 124 located in the bore 122. The piston 124 preferably is generally cylindrical in shape having a large diameter section 128 carrying an annular seal 129 and forming a valve member in engagement with the tapered portion 123 of the counterbore 122 which forms a valve seat. A series of Belville washers 126 surround the piston 124 adjacent the large diameter section 128. A tubular plug 130 is threaded into the bore 122, and compresses the belville washers 126 against the large diameter section 128 of piston 124, forcing the forward face of section 128 towards the annular surface 123 of the counterbore 122. An additional stack of belville washers 131 positioned within the plug 130 is compressed against a sleeve 133 located in the end of the piston 124 by an adjustable plug 158 threaded into the plug 130.

A ring seal 135 is provided to prevent leakage of fluid from the tool 20 between the housing 22 and plug 130, and another seal 135 is preferably provided between plug 158 and plug 130.

Referring still to FIG. 3, a central bore 154 is located in the bypass piston 124. A relief check valve 156 located within the bore 154 is urged closed by a spring 155 engaging a plunger 157 adjacent the valve 156. In order that the pressure at which the check valve 156 opens may be adjusted, the spring 155 may be compressed utilizing the plug 158 which is threaded into the end of the plug 130. The area between the large diameter section 128 of the piston 124 and plug 130 is connected to the reservoir 34 by a suitable passage.

In order that fluid located in the piston pressure chamber 116 reach the bypass piston 124, a passage 146 extends through the housing 22 from the chamber 116 to the passage 144. Preferably, passage 146 runs in a nearly horizontal plane and in a straight line from the chamber 116 to the connection with passage 144. Passage 144 connects a relief plunger 139 (described in more detail below and illustrated in FIG. 4) to the end of the bore 122 in the housing 22 where the bypass piston 124 is located. As illustrated in FIG. 3, this passage 144 runs generally vertically perpendicular to the centerline of the housing 22. Passage 144 may be produced in the housing 22 by drilling a bore into the housing 22 and then plugging the end of the bore on the outside of the housing 22 with a sealed plug.

As seen in FIG. 3, another passage 148 connects the pressure chamber 102 to the bore 122 in which the bypass piston 124 is located. This passage 148 runs perpendicular to the centerline of the housing 22, and thus runs generally parallel to passage 144. Passage 148 may be produced in the housing 22 by drilling a bore into the housing 22 and then plugging the end of the bore on the outside of the housing 22 with a sealed plug.

The connection of the main piston chamber 116 to the relief piston 124 allows high pressure fluid located in the chamber 116 to shift the piston 124 to the right in FIG. 3, at a predetermined high pressure, to open the bypass valve 128. Also, a higher pressure will open the safety valve 156 and relieve the pressure in the third pressure chamber 116 automatically, if the pressure becomes excessive.

Figure 4:
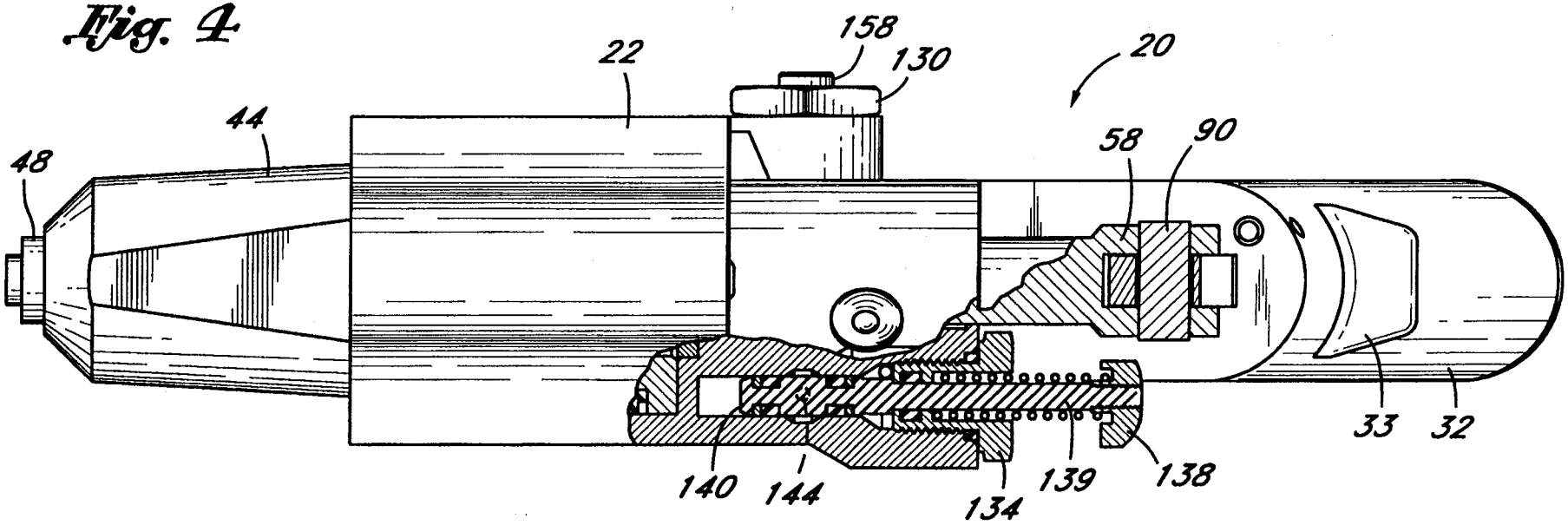
FIG. 4 is a partial cross-sectional view of the tool of the present invention, illustrating the top of the tool and a cross-section of the manual pressure relief.
Figure 4A:
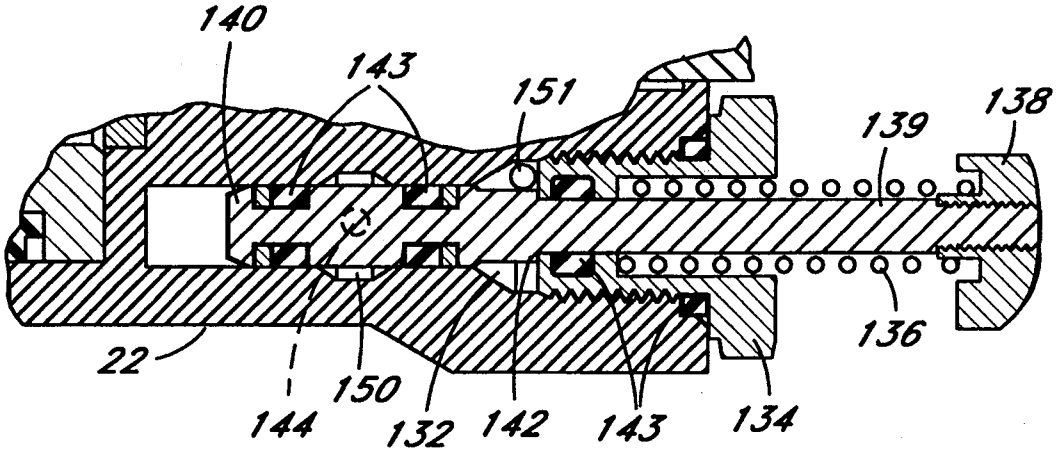
FIG. 4*a* is a partial exploded view of FIG. 4.

As best seen in FIGS. 4 and 4*a*, a system for manually relieving the pressure in the main chamber 116 is also provided. This system includes a relief plunger 139, which has a head 138 and tail 140 and is located partially within a bore 132 which is located in the closed end 26 of the housing 22 above the bypass piston 124. The bore 132 is located a distance away from the centerline of the housing 22, but preferably in the same horizontal plane, and to the rear of the large diameter portion of the housing 22. As seen from FIG. 5, the relief plunger does not extend the length of the tool, nor add appreciably to the diameter beyond the large diameter portion of the housing 22.

A sleeve nut 134 is located in the end of the bore 132. The plunger 139 extends through the sleeve 134 into the bore 132 in the housing 22. A spring 136 located between the head 138 of the plunger 139 and the sleeve 134 biases the plunger 139 in a direction out of the bore 132. The plunger 139 is prevented from being removed from the bore 132, however, through the engagement of a flange 142 located on the plunger 130 engaging the sleeve nut 134. Sealing rings 143 are preferably located on the plunger 130 and sleeve 134, creating fluid seals between the plunger 130, sleeve 134, and housing 22, and the bore 132.

The high pressure passage 144 shown in FIG. 3 is open to the enlarged portion 150 of the bore 132, shown in FIGS. 4 and 4*a*. A return way 151 in the large diameter section of the bore 132 leads back to the reservoir 34 in the handle 32. When the plunger 130 is in its static position, fluid located between the seals 143 is not allowed to move out of the bore 132. However, when the plunger 130 is pushed inwardly against the spring 136, the high pressure port passage 144 connects to the return way 151.

Operation

Figure 5:
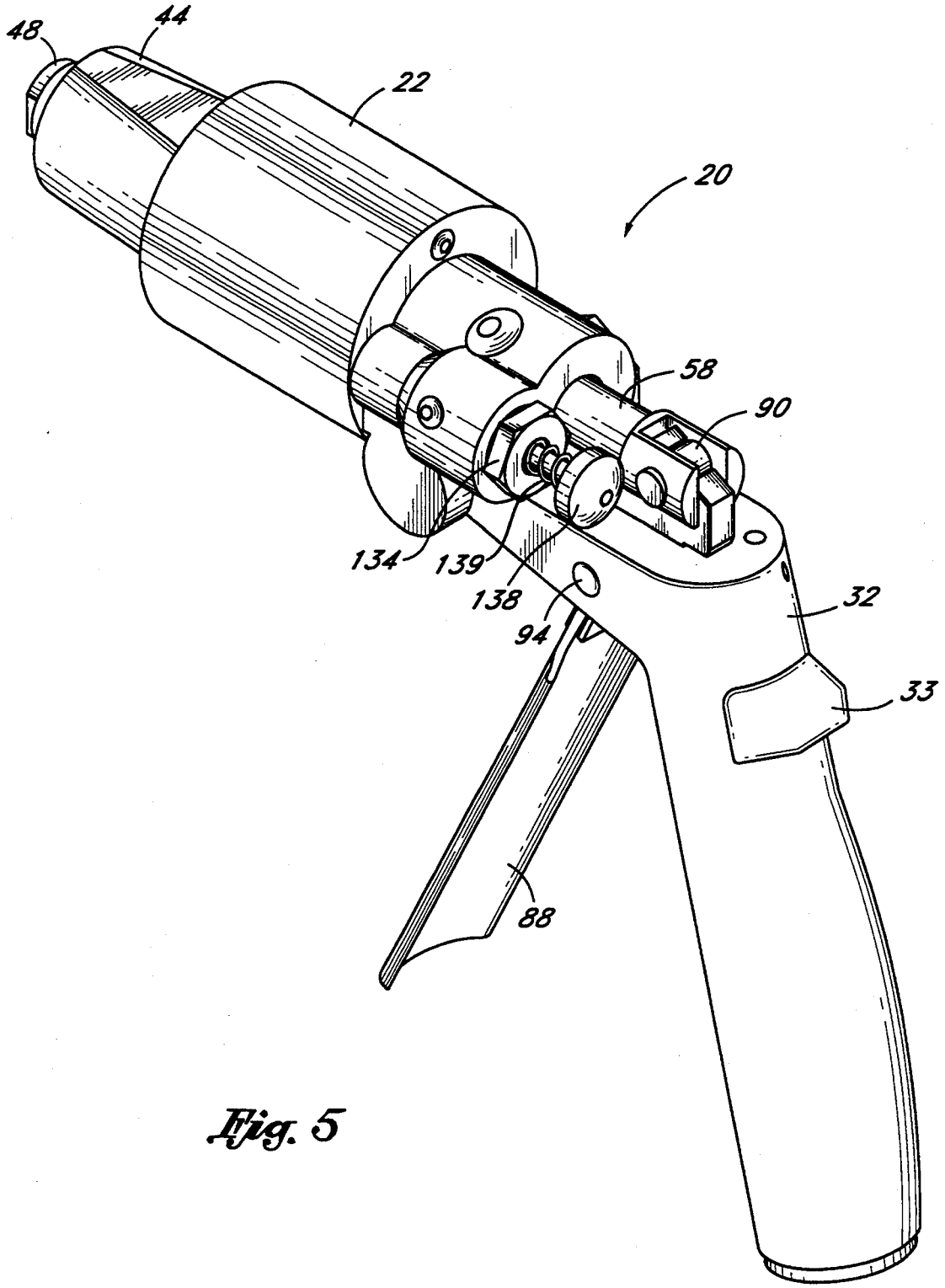
FIG. 5 is a perspective view of a tool of the present invention.

In operation, the operator grips the tool 20 of FIG. 5 in one hand, and the stem 170 of a fastener 172 is inserted into the bore 50 to be gripped by the jaws 60, as shown in FIG. 6. The spring 68 permits the jaws 60 to retract enough to allow the stem to be inserted. The anvil 48 engages the head 174 of the fastener. The fastener is then inserted in a workpiece 176, or it can be positioned in the workpiece before being gripped by the tool.

The lever 88 is then pulled with the fingers towards the handle 32, causing the plunger 58 to be forced inwardly into the housing 22, pressing upon the fluid in the first and second pump chambers 102 and 106. Each stroke of the lever 88 causes fluid in these chambers 102, 106 to pass through the passages 118, and by the one-way valve rings 120 covering those passages. In this manner, fluid is pumped from the pump chambers 102, 106 into the main piston chamber 116. During each return stroke of plunger 58, caused by the spring 98, fluid from the reservoir 34 is drawn through passageway 100, past check valve 104 (FIG. 2) into the chamber 102 and into the chamber 106 through passage 108. Pressurized fluid filling the main pressure chamber 116, causes rearward movement of the drawbolt 52 and housing 22 while the nosepiece 44 and the piston 43 remains stationary with respect to the fixed workpiece.

As can best be seen in FIG. 6, during the initial stages of setting the fastener, squeezing of the lever 88 causes the introduction of fluid into the main pressure chamber 116 from both the pump chambers 102, 106. A pressure stroke of the plunger 58 causes the fluid to be compressed into the chamber 116 from the pump chamber 102 through the rear passage 114 because of the shoulder 59 of the larger diameter section of the plunger 58, and from the pump chamber 106 through the passage 119 because of the internal end of the plunger 58. The passage 118 is not mandatory in that pressurized fluid can flow from chamber 102 to chamber 106 through check valve 110.

Increasing fluid in the chamber 116 causes the stem 170 to be pulled through the sleeve of the fastener. As can be seen in FIG. 6, fluid pressure in the chamber 116 exerts a force against the flange 70 on the drawbolt 52. The force causes the drawbolt and the housing 22 to move backwards along the nose piece 44, away from the forward end 47 of the nose piece 44. Once the housing 22 and piston 43 are separated by a slight space, the fluid in the third pressure chamber 116 is applied to the annular housing wall **22*a* at the end of the large bore 24 in the housing 22, increasing the pulling force on the drawbolt 52, pulling the fastener stem 170, as seen in FIG. 7**.

After several strokes of the lever 88, the pressure in the third pressure chamber 116 increases to the level that, if controlled, the lever 88 would become very difficult to squeeze. However, at this point, the tool of the present invention provides a unique second stage feature which automatically reduces the required squeezing force, while still generating enough pump pressure to cause fluid to flow into the chamber 116, and thus increasing the pulling force created on the stem 170 of the fastener.

As noted above in connection with FIG. 3, fluid in the main piston chamber 116, which is connected to passageways 146 and 144 is applied to the end of the bypass piston 124. When this force exceeds the force exerted by the belville washers 126 in the opposite direction, the piston 124 is moved towards the belville washers 126, opening the bypass valve 128. This allows fluid from the first pump chamber 102, which is connected to the bore 122 in which the bypass piston 124 is located via passage 148, to flow through the bypass valve 128 into the area occupied by the belville washers 126 to return to the reservoir 34. Thus, at a preset pressure (determined by the number and rigidity of the belville washers 126) the high pressure in the main pressure chamber 116 causes the pressure chamber 102 to be bypassed or become ineffective for pumping.

Further strokes of the plunger 58 cause fluid to be introduced into the pump chambers 102, 106. However, at this time, the force which is necessary to move the plunger 58, and thus the force necessary to squeeze the lever 88, is much reduced. This is because the fluid in the chamber 102 is not compressed into the high-pressure chamber 116, but is bypassed back to the reservoir, so there is no opposing force to the movement of the plunger 58 in chamber 102. At that point, only the fluid in the pressure chamber 106 is opposing movement of the plunger 58.

It can be demonstrated that just before the pressure chamber 102 is bypassed, for a given force applied on the lever 88 and plunger 58, the pressure P applied to the fluid in the pump chambers 102, 106 is $P=F/(A1+A2)$, where A1 represents the area of the plunger shoulder 59 which is pressing on the fluid in the chamber 102, and where A2 represents the area of the forward end of the plunger 58 which is pressing on the fluid in the chamber 106. When, however, the pump chamber 102 is bypassed, area A1 is effectively rendered useless, as there is no compression of the fluid into the chamber 116 from this chamber 102. Thus, in this instance $P=F/A2$. Because the area has decreased, for a similar force F applied to the lever 88, the pressure generated in the second pump chamber 106 increases, causing fluid to be pushed into the chamber 116, causing the pressure in the chamber 116 to rise.

It is noted that while it is possible to design the tool 20 such that only the smaller plunger area exists, whereby the force needed to actuate lever 88 is insured not to become too large, this is not preferred. In such an arrangement, as is found in the prior art, each stroke of the plunger pumps the same small change in the volume of fluid in the pressure chamber which moves the piston/housing, because of the small area which is utilized to apply the plunger force to the fluid. This is desirable from the standpoint that the force necessary to squeeze the handle does not become too large. However, at the same time, in the initial stage of the pulling, when the force required is low only the same small quantity of fluid is being pumped on each stroke. Thus an excessive number of strokes are necessary to set the fastener.

The two stage mechanism allows large changes in fluid volume per stroke in the initial stages of pumping, whereby movement of the drawbolt 52 during initial strokes of the plunger 58 is faster. However, as the pressure increases to a level at which the lever 88 becomes difficult to squeeze, the slower rate of movement of the drawbolt 52 is acceptable in order that the force which must be applied to the lever 88 be kept at an acceptable level.

The continued high pressure in chamber 116 of course continues high pressure in the passages 144 and 146, causing the bypass valve 128 to remain in its open state.

After the fastener stem has been pulled to a point where it is separated from the portions in the sleeve, just after the condition illustrated in FIG. 7, the pressure in the entire system is manually relieved in order that the drawbolt 52 may return to its original state as shown in FIG. 1. To relieve the pressure, the plunger 139 of FIG. **4*a* is pressed inwardly into the bore 132. This enables fluid which is in the third pressure chamber 116, which is connected to bore 132 through passages 146 and 144, to move through bore 132 to the return way 151 and back to the reservoir 34. After removal of the broken stem tail protruding from the anvil 48, the tool 20** is ready for use in setting another fastener.

It should be noted that if the tool is operating in the high pressure mode, and the pressure in the piston chamber falls below the pressure required to hold the bypass valve open, the tool would automatically revert to the low pressure mode. Some fasteners might have such a pulling load and hence the tool would effectively accommodate that type.

The pulling load to set a fastener of course varies with the fastener design, but typical loads for fasteners of the type likely to be installed by a hand pumped hydraulic tool, are likely to be in the range of 1200 to 3500 pounds. Maximum comfortable pulling loads on the handle finger lever vary in the range from 50 to 60 pounds. Thus the pressure at which the tool is to shift from the low load mode (full area plunger) to the high load mode (reduced area plunger) can be selected by adjusting the spring pressure for the bypass valve to obtain an acceptable or desirable handle lever load.

In a prototype example of the product, a 53 pound maximum handle lever load was selected. With the dimensions selected for the various components, this caused shifting to the high pressure mode at the point at which the draw bolt was producing a 1400 pound pulling force. A little more than two strokes of the handle lever were required to attain the pressure to open the bypass valve. Approximately five and a half additional strokes were then required to attain the 3500 pounds of pulling force required to set the fastener.

By contrast, if the plunger were operated utilizing only the smaller plunger work area so as not to exceed the maximum finger load pressure felt with the dual mode operation, approximately eleven strokes would be required to attain the 3500 pound pressure required to set the fastener. As can be seen, the dual mode operation is much more efficient, producing the same amount of work with three fewer strokes of the plunger. If the tool is used with fasteners that require only smaller force, the tool of the invention is correspondingly more advantageous from an efficiency standpoint.

Figure 8:
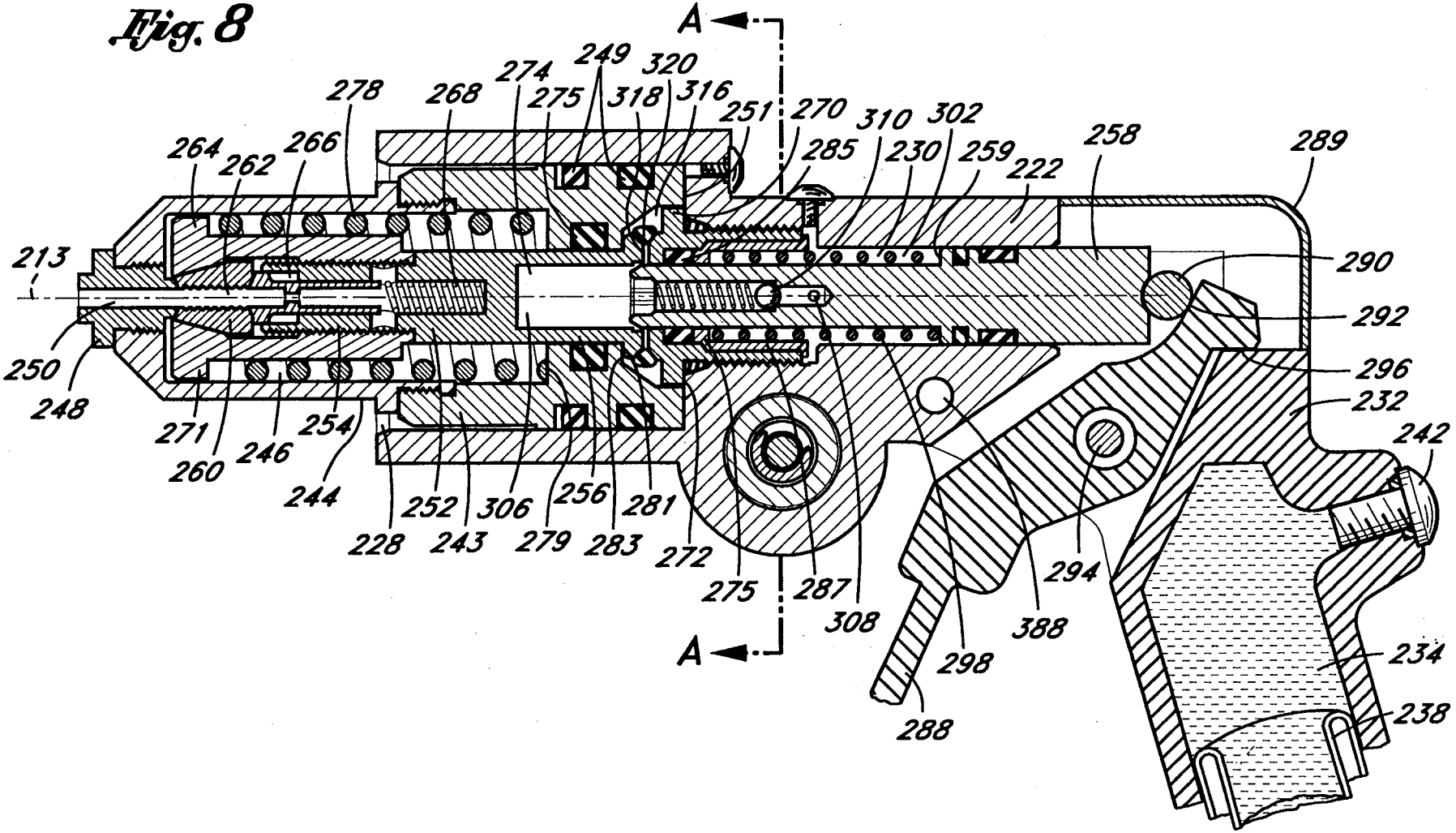
FIG. 8 is a partial cross-sectional side view of the preferred embodiment tool of the present invention taken along the centerline of a housing, plunger, and piston of the tool.
Figure 9:
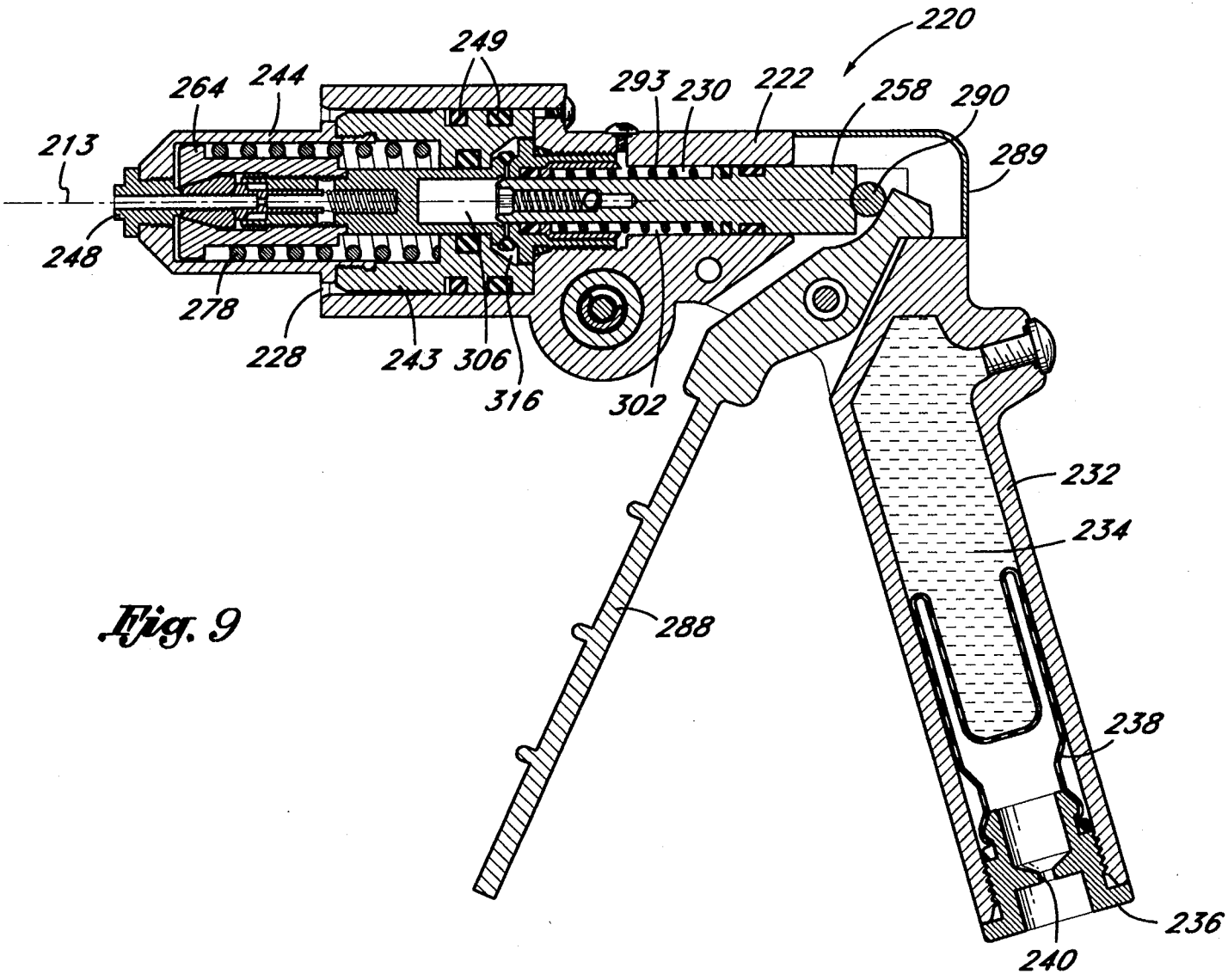
FIG. 9 is a full cross-sectional view of the tool in FIG. 8.

Illustrated in FIGS. 8–15 is a preferred embodiment tool 220 of the present invention. As illustrated in FIGS. 8 and 9, the tool 220 includes a substantially cylindrical housing 222 having a centerline 23, a forward, large diameter open end and a smaller diameter rear end. Preferably, the housing 222 has a similar size and construction to the housing 222 described above. A large bore 228, preferably having a diameter of about 1.4 inches, extends inwardly from the forward end of the housing 222 along the centerline, preferably about 1.6 inches. A small bore 230 passes from the end of the large bore 228 through to the rear end of the housing 222 along the centerline.

A handle 232 extends from a lower portion of the rear end of the housing 222. Preferably, this handle 232 is constructed as part of the housing 222, although it is possible to attach a separately formed handle.

Figure 15:
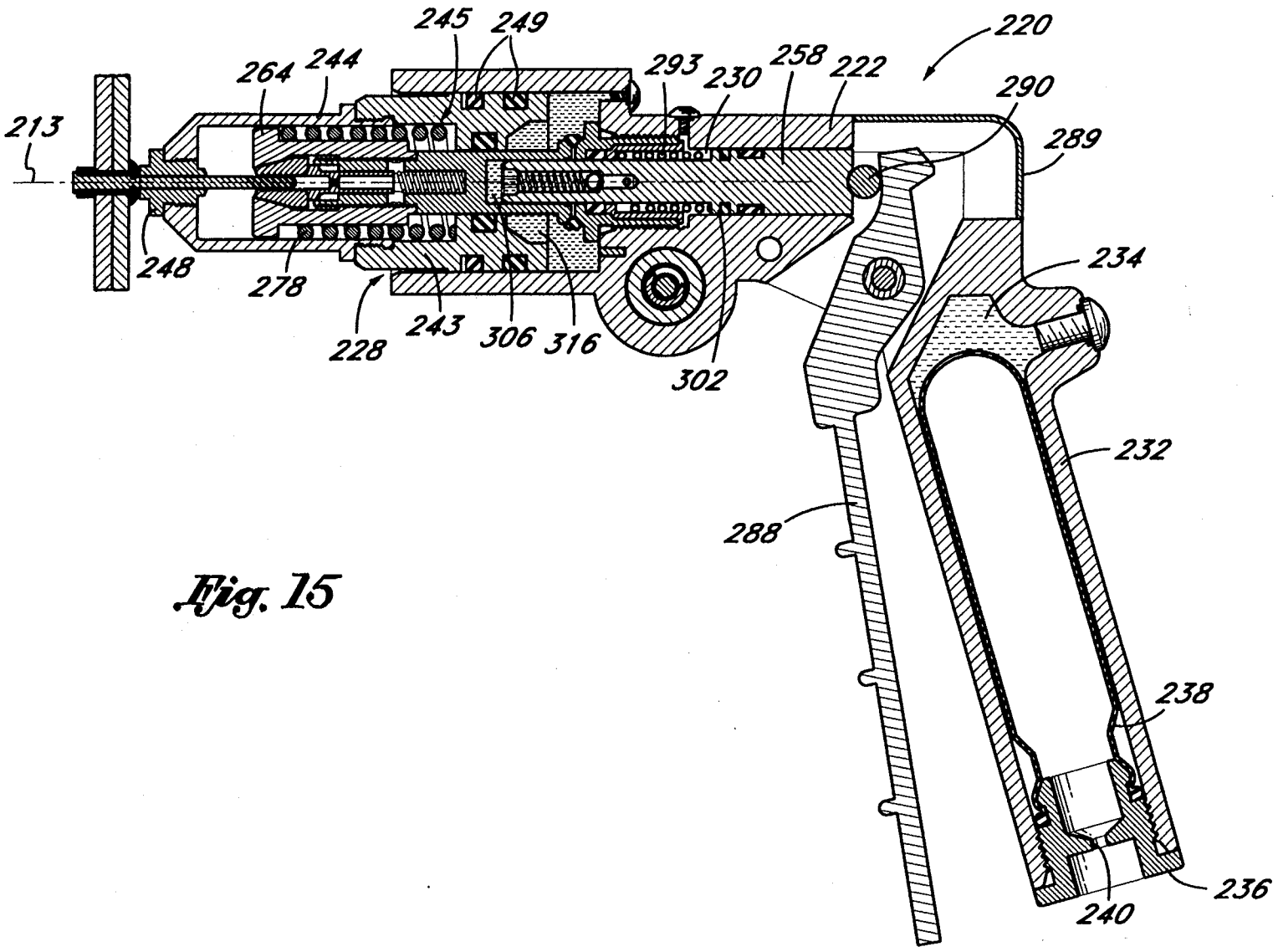
FIG. 15 is a cross-sectional side view of the tool in FIG. 14, illustrating the tool after the completion of the setting of a fastener.

As seen in FIG. 9, a preferably cylindrical reservoir 234 extends from within the lower end of the handle 32 opposite the housing 222, into the upper end of the handle. A flexible, tubular bladder 238 is located in the reservoir 234, having a closed upper end and an open lower end positioned in sealing relation on a plug 236 threaded in the lower end of the handle arrangement. The bladder 238 normally has an extended shape that conforms to the interior wall of the handle. As seen in FIG. 15, when not displaced by liquid in the reservoir, the interior of the bladder 238 is connected to the atmosphere by a passage 240 in the plug. FIG. 9 illustrates the bladder 238 when the majority of the liquid is in the reservoir 234. As seen, the closed end of the bladder 238 is displaced toward the open end. A fill plug 242 threaded into the upper end of the handle 232 allows fluid to be added or removed from the reservoir 232.

Referring again to FIG. 8, a short cylindrical, main piston 243 is slidably located within the large bore 228 of the housing 222. A pair of sealing rings 249 are located on the outside of the piston 243 between the piston 243 and housing 222, so as to prevent hydraulic fluid from passing between the piston 243 and housing 222.

A nose piece 244 or other sleeve engaging element has a rear end threadably connected to the forward end of the piston 243, and a forward end protruding from the housing open end 224. The nose piece 244 is primarily cylindrical on its outside surface, and has a center hollow bore 246 extending entirely therethrough. The nose piece 244 is attached to the piston 243 after the insertion of a drawbolt 252 and a coil spring 278, which will be described in more detail below.

A tubular anvil 248 which may be considered a part of the nosepiece is threaded into the forward end of the nose piece 244 outside of the housing 222. The anvil 248 is preferably flat on its forward face for engaging the sleeve head of the fastener. A central bore 250 extends through the anvil 248 to receive a fastener stem.

The drawbolt 252 is located within the nose piece 244, the piston 243, and the housing 222, extending from near the forward end 247 of the nose piece 244, to the small bore 230 in the housing 222. The drawbolt 252 is generally cylindrical, having a forward end 254 adapted for engagement with the stem of a fastener, and a tubular rear end 256 threaded into the housing 222. As can be seen, a number of sealing rings 257 are located on the housing 222 and piston 243 at points of engagement of these members, so as to provide a fluid seal between these members.

Suitable stem gripping means 260 is located at the forward end 254 of the drawbolt 252, including two or more jaws 260 defining a central hole 262 into which a fastener stem may be inserted and gripped securely. The jaws 260 are captured within the forward end of a tubular collet 264 having a rear end threaded on the forward end of the drawbolt 252.

A tubular pin 266 located within a counterbore in the first end 265 of the drawbolt 252, is biased forwardly against the jaws 260 by a spring 268 located in the counterbore between the drawbolt 252 and the pin 266. In this fashion, the pin 266 forces forward tapered surfaces on the jaws 260 against an inner conical, oppositely tapered, portion of the collet 264, whereby the jaws 260 are biased radially inwardly into a closed position about a stem inserted therein. For stability, the pin 266 is partially counterbored so that the stem may extend partially therein.

An outwardly extending flange 270 located on the rear end 256 of the drawbolt 252 engages the housing 222 at an annular ledge 272 located within the small bore 230 in the housing.

A large coil spring 278 surrounds the forward end 254 of the drawbolt 252, extending between a forward face 279 of the piston 243 and an outwardly extending flange 281 of the collet 264. The spring 278 thus urges the piston 243 rearwardly in the housing 222 causing an interior shoulder 283 to engage an annular rib 281 on the drawbolt 252, and urging the drawbolt 252 and housing 222 forwardly.

Art elongated cylindrical bore 274 extends from the rear 256 of the drawbolt 252 to about half way into the drawbolt.

A plunger 258 having a relatively small diameter forward end is located within a correspondingly small diameter portion of the bore 274 in the rear of the drawbolt 252. The plunger has a larger diameter rear end which slides within the housing 222, and includes a portion extending out of the housing near the handle 232. The plunger 258 is a primarily cylindrical shaft located along the centerline of the housing 222.

In order to prevent fluid from leaking along the drawbolt 252/plunger 258 interface, a seal 285 is located between the two at the point where the bore 274 widens. This seal 285 is forced in place through the use of a short tube member 287 having a small shoulder 275 which is slid into the bore 274 and pressed against the seal 285 by a plunger coil spring 298 that surrounds the plunger 258.

A lever 288, easily grippable with the fingers of one hand, is operatively connected to the rear of the plunger 258. The lever surface 292 engages the side of a rolling drive element 290, capturing it between the lever and the plunger 258. The lever 288 is pivotably mounted on a pivot pin 294 mounted on the housing 222 near the handle 232. In this fashion, the lever 288 pivots about the pin 294, and through the element 290 reciprocates the plunger 258 along the housing axis 223. A stop 296 on the rear of the lever 288 near the engaging surface 292 engages the housing 222 so as to limit the range of motion of the lever 288, and thus the rearward motion of the plunger 258. A cover 289 may be located over the lever 288/plunger 258 connection area to protect it from dirt, etc., and to protect the user.

As illustrated in FIG. 8, the coil spring 298 which holds the plunger seal 285 in place extends between an annular shoulder 259 marking the large diameter section of the plunger 258 and the annular shoulder 275 on the tubular member 275. In this manner, spring 298 biases the plunger 258 rearwardly relative to the rear end 226 the housing 222.

In order that the tool 220 be hydraulically operated, a first pressure chamber 302 is connected to the fluid containing reservoir 234. The chamber 302 is defined by the large diameter portion of bore 274 in the drawbolt 252, the bore 230 in the housing 222, the plunger shoulder 259, and the drawbolt shoulder 275. The spring 298 is confined within the chamber 302.

A second pump pressure chamber 306 connected to the first pressure chamber 302 is defined by the internal end of the plunger 258 and the end of the bore 274 in the drawbolt 252. A passage 308 in the end of the plunger connects the pump pressure chambers 302 and 306, by way of one or more radial passage portions. A check valve 310 is located in the passage 308 and is oriented to allow flow of fluid only from the first chamber 302 to the second chamber 306. Preferably, this check valve 310 comprises a ball urged by a coil spring held in place by a tubular plug threaded into the plunger.

A piston or third pressure chamber 316 is defined on ends by the annular piston shoulder 283, and the flange 270 on the drawbolt 252 when closed as shown in FIG. 8, and also on the ends by the annular rear face 251 of the piston 243 and the annular end wall 272 of the housing, when the piston has moved. The chamber 316 is defined on cylindrical sides by the drawbolt wall 253, the piston wall 241 and the housing wall 227. The piston pressure chamber 316 is connected to the first pump chambers 302 and 306 by a radial passage 318 through the drawbolt. A resilient ring 320 is located within the third chamber 316 on the exterior of the drawbolt 252 where the passage 318 exits into the third chamber 316. The ring 320 acts as a check valve, permitting pressurized liquid flow into the piston pressure chamber 116, while preventing reverse flow.

In accordance with this preferred embodiment, a unique single system is provided for attaining high pressure in chamber 316 with reduced force required to actuate the plunger 258; for relieving excessively high pressure in the third chamber 316; and for manually relieving the pressure in the system and resetting the tool. This system has the advantage of accomplishing all three functions in a single compact unit, thus reducing the size of the tool and making it cheaper and easier to manufacture.

Figure 11:
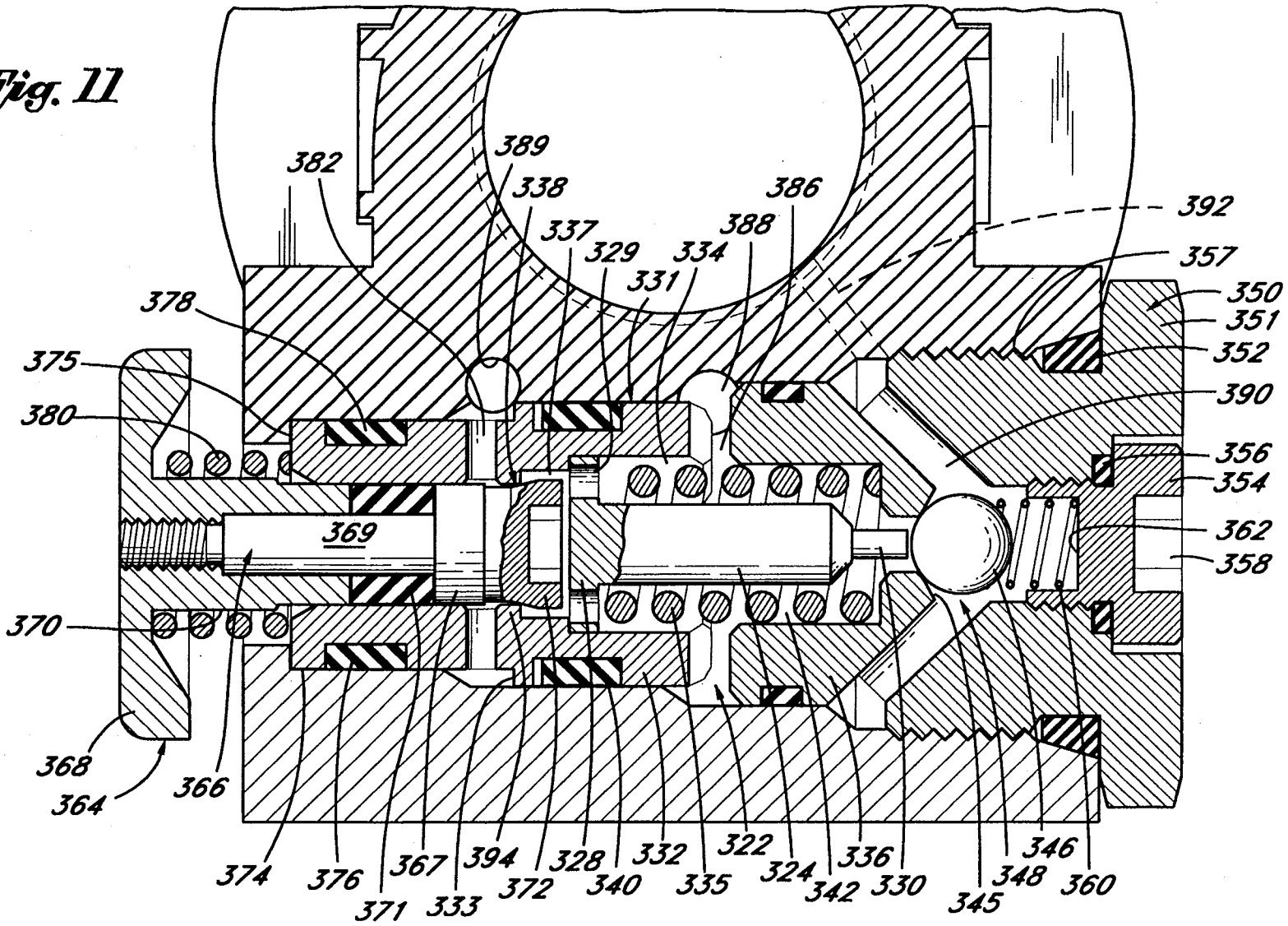
FIG. 11 is a cross-sectional view of the tool of FIG. 8 taken along line A—A illustrating the tool when it is in its low-pressure mode.

More specifically, there is provided means for automatically converting the tool from a low pressure mode to a high pressure mode bypassing back to the reservoir the hydraulic pressure which is developed in the first pressure chamber 102. As illustrated in FIG. 11, this system includes a cylindrical bore 322 located in the housing 222, with its longitudinal axis perpendicular to the centerline of the housing 222, and to the rear of the large diameter bore portion of the housing. Further, the counterbore 322 is located below the plunger 258, and thus does not add to the length of the tool. The counterbore 322 extends through the housing 222 and has a small diameter at one end that widens in stages to a large diameter at the other end.

The system includes a sleeve-like piston 331 positioned primarily in the smaller diameter end of the counterbore 322, with the exterior cylindrical walls of the piston slidably engaging the surrounding walls of the counterbore. More specifically, the piston includes an outer sleeve-like section 374 normally engaging a shoulder 375 formed in the housing 222 at a change of diameter in the counterbore. The inner end, or right-hand section 332, as viewed in FIG. 11, of the piston 331 has a larger diameter than the axial outer section 374, whereby an annular shoulder 333 is created at the diameter change. The annular area of the shoulder is subjected to the high pressure in the pump piston chamber 316 by way of a conduit 389.

An annular seal 378 positioned in a groove within the piston section 374 and an annular seal 340 positioned in the piston section 332 prevents the high-pressure liquid from leaking between the piston and the housing 222.

A tubular plug 350 is positioned in the large-diameter end, or right-hand end as viewed in FIG. 11, of the counterbore 322. The plug includes a large diameter section 357, which is threaded into a large diameter threaded section of the counterbore 322, while an inner smaller diameter, tubular section 336 is positioned in a correspondingly smaller diameter section of the counterbore 322. An outer head 351 on the plug 350 engages the exterior of the housing 222 while clamping an annular seal 352 between the plug and the housing to prevent leakage of low-pressure fluid in that area.

Positioned within the tubular plug is a ball-type check valve 34, including a ball 346 normally held in engagement against a valve seat 345 by means of a coil spring 360 extending between the ball and a smaller diameter plug or nut 354 threaded into a threaded bore in the larger plug 350. An annular seal 356 is positioned within a recess in the plug 350 and is clamped in that position by the head of the plug 354. Preferably, the head of the plug 354 has a recessed wrench socket 358 so the nut may be easily installed after the ball and spring have been positioned within the plug 350. The outer end of the spring 360 fits within a socket 362 formed in the inner end of the plug 354.

A plurality of circumferentially spaced passages 390 are formed in the plug 350 in the transition between the threaded section 357 and the unthreaded section 336. The passages communicate with a passage 392 leading to the pump plunger chamber 302, thus connecting that chamber to the check valve 344. An annular seal 353 surrounds the plug section 336 and, together with the seal 352, prevents leakage from the passage 392 between the housing 322 and the plug 350.

As can be seen, the piston inner end 332 and the plug inner end 336 are closely positioned, but are spaced to accommodate movement of the piston 331. A bypass valve actuator 324 is positioned within tubular ends of the piston section 332 and the plug end 336. More specifically, the actuator 324 has a generally cylindrical shape, with a large diameter head 328 on one end fitting within the large diameter portion 334 of the piston section 332. A smaller diameter ball engaging tip 330 on the other end is positioned within the orifice of the check valve 344 adjacent to the valve ball 346. The central section of the actuator 324 extends between the actuator ends spanning the gap between the piston section 332 and the plug section 336. A substantial coil spring 335 surrounds the actuator 324, with one end of the spring anchored against the end of the socket 342 in the plug section 336 and the other end of the spring engaging the actuator head 328 and pressing it against the end of the piston portion 34. The chamber formed by the sleeve section 334 and the plug socket 342 is open to an annular gap 386 open to a passage 388 leading to the reservoir 234.

Positioned within the tubular piston section 332 is a valve 338 which functions as a high-pressure relief and a manual relief for the hydraulic hand tool. The valve includes a valve stem 366 having an end 372 which forms a valve member and which cooperates with a valve seat 394 formed in the piston 332. More specifically, the valve member 372 has a cylindrical portion that extends through the valve orifice in the valve seat 394 and a larger diameter cylindrical inner end which is positioned within sleeve section 337 and with the ends of the cylindrical portion 372 being connected by a tapered or frustoconically shaped portion which engages the end of the sleeve bore that forms the valve seat 394. One side of the valve seat is open to the reservoir 234 by way of holes 329 in the valve actuator head 328, the chamber through the sleeve section 334, the gap between the plug 350 and the piston 332, and the reservoir passage 388. The other side of the relief valve 338 is exposed to the high pressure in the passage 389 by way of a plurality of radially extending passages 382 formed in the piston 331.

The valve stem 366 is also provided with a central cylindrical portion 367, which slides within the interior cylindrical bore of the piston sleeve section 374. The stem 364 further includes a longer, smaller diameter neck 369 connected on one end to the central portion 367 and threadably connected on its opposite outer end to the threaded stem 366 of the knob 368. As may be seen, the knob stem extends through the small diameter end of the counterbore 322. A coil spring 380 surrounds the knob stem 366, with one end of the spring engaging the flat annular end of the piston sleeve section 374 and the other end of the spring engaging the underside of the knob 368, thereby urging the valve 338 closed. An annular seal 371 surrounds the central neck of the stem 364 to prevent leakage between the stem and the surrounding bore in the sleeve section 374.

Operation of Embodiment of FIGS. 8–15

Figure 10:
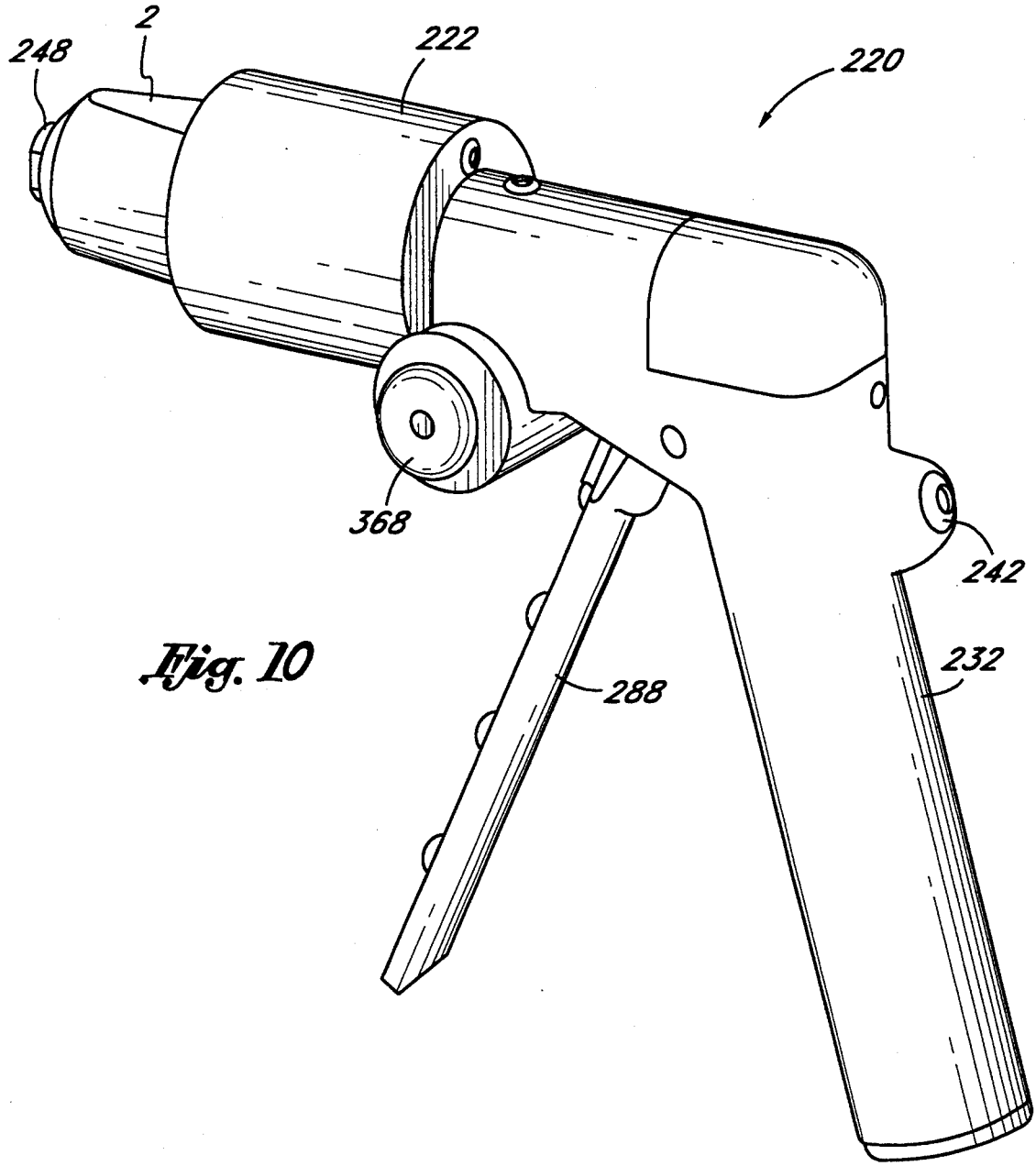
FIG. 10 is a perspective view of the preferred embodiment tool of the present invention.
Figure 14:
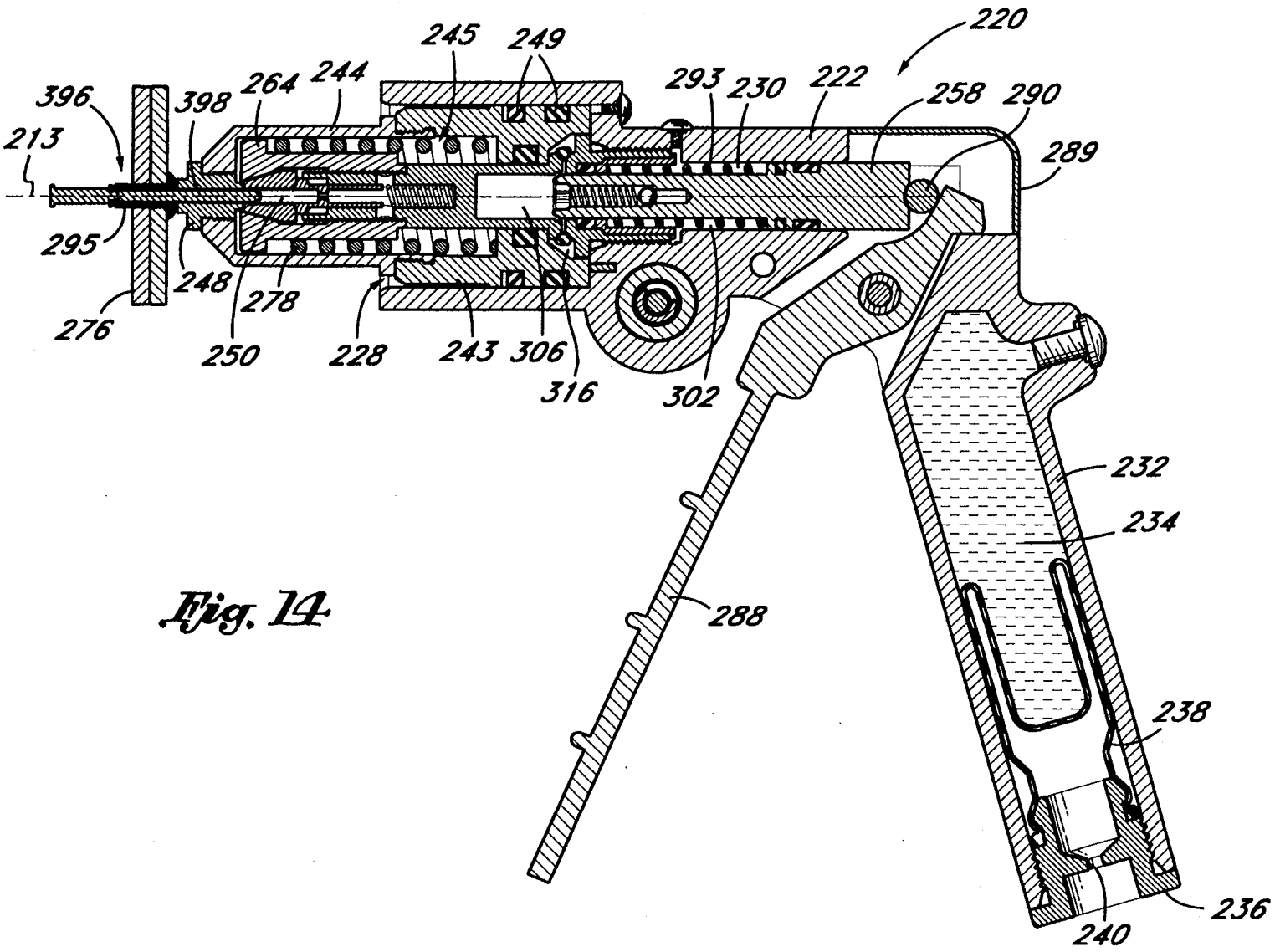
FIG. 14 is a cross-sectional side view of the tool of FIG. 10 taken along the centerline of the tool, illustrating the tool after initial engagement with a fastener.

In operation, the operator grips the tool 220 of FIG. 10 in one hand, and the stem 398 of a fastener 396 is inserted into the bore 250 to be gripped by the jaws 260, as shown in FIG. 14. The spring 268 permits the jaws 260 to retract enough to allow the stem to be inserted. The anvil 248 engages the head of the sleeve 397. The fastener 396 is then inserted in a workpiece 376, or it can be positioned in the workpiece before being gripped by the tool.

The lever 288 is then pulled with the fingers towards the handle 232, causing the plunger 258 to be forced inwardly into the housing 222, pressing upon the fluid in the first and second pump chambers 302 and 306. Each stroke of the lever 288 causes fluid in these chambers 302 and 306 to pass through the passage 318, and by the one-way valve ring 320 covering that passage. In this manner, fluid is pumped from the pump chambers 302,306 into the main piston chamber 316. During each return stroke of plunger 258, caused by the spring 298, fluid from the reservoir 234 is drawn through passageway 300, past check valve 348 into the chamber 302 and into the chamber 306 through passage 308. The return stroke of the plunger creates a reduced pressure in the pump chambers that draws liquid from the reservoir, and this is assisted by the reservoir pressure created by the resiliency of the bladder 238 backed by atmospheric pressure on the exterior of the bladder by way of the hole 240, as seen in FIG. 9.

Pressurized fluid filling the main pressure chamber 316, causes rearward movement of the drawbolt 252 and housing 222 while the piston 243 remains stationary against the fixed workpiece. Increasing fluid in the chamber 316 causes the stem 370 to be pulled through the sleeve of the fastener. As can be seen in FIG. 14, fluid pressure in the chamber 316 exerts a force against the flange 270 on the drawbolt 252. The force causes the drawbolt and the housing 222, which interengages the flange 270 at end wall 272, to move backwards along the nose piece 244, away from the forward end 247 of the nose piece 244. Once the housing 222 and piston 243 are separated by a slight space, the fluid in the third pressure chamber 316 is applied to the entire area of the housing end wall 272 at the end of the large bore 224 in the housing 222, increasing the pulling force on the drawbolt 252, pulling the fastener stem 396.

After several strokes of the lever 288, the pressure in the third pressure chamber 316 increases to the level that the lever 288 becomes difficult to squeeze. However, at this point, the tool of the present invention provides a unique second stage feature which automatically reduces the required squeezing force, while still generating enough pump pressure to cause fluid to flow into the chamber 316, and thus increasing the pulling force created on the stem 370 of the fastener.

Figure 12:
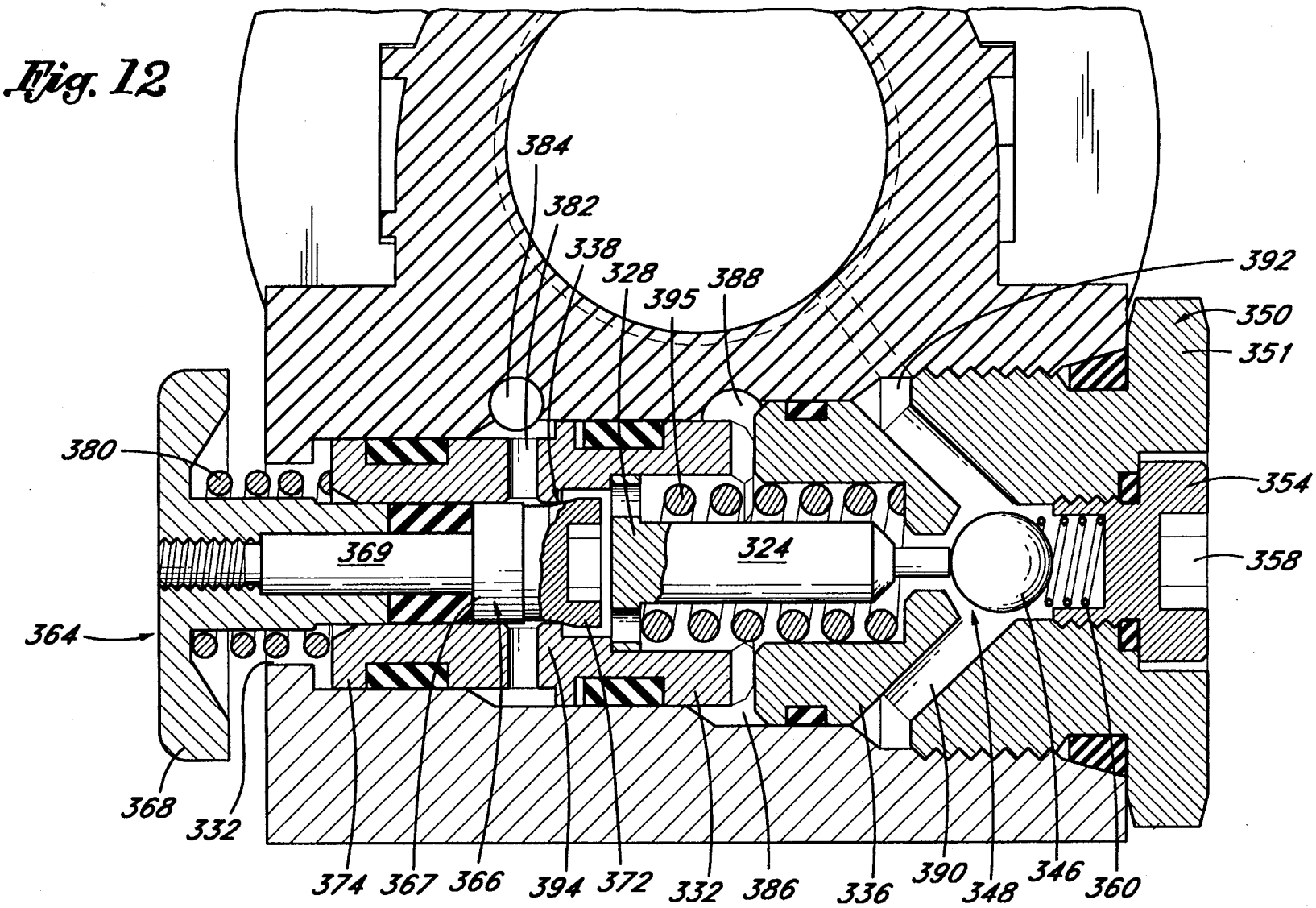
FIG. 12 is a cross-sectional view of the tool of FIG. 8 taken along line A—A illustrating the tool when the first stage relief system is operating.

As noted above, fluid in the main piston chamber 316, which is connected to passage 389 is connected to the passage 382. As illustrated in FIG. 12, the fluid in the passage 382 acts upon the annular shoulder 333 of piston 332, causing it to move axially toward the plug section 336, pressing the actuator 324 in the same direction against the force of the strong piston spring 345. Sufficiently high pressure causes the piston 332 to move the actuator 324 axially until the small tip 330 presses the ball 346 of the check valve 348 away from the valve seat 345, thus connecting the passages 386 and 390. When these two passages 386 and 390 are connected, fluid flows from first pump chamber 302, through passages 392, 390, 386 and 388, and back to the reservoir 234. Note that the piston 332 movement is limited by its engagement with the plug section 336. Grooves in the end of the piston 332 permit fluid flow in that condition.

Thus, at a preset pressure (determined by selecting the stiffness of the spring 345) the high pressure in the piston pressure chamber 316 causes the first pump plunger pressure chamber 302 to be bypassed or become ineffective for pumping. In a prototype of the pump of the invention, the spring 345 provides 40–50 lbs. of force.

Further strokes of the plunger 258 cause fluid to be introduced into the first and second pump chambers 302, 306. However, at this time, the force which is necessary to move the plunger 258, and thus the force necessary to squeeze the lever 288, is much reduced. This is because the fluid in the chamber 302 is not compressed, but is returned back to the reservoir 234, so there is little opposing force to the movement of the plunger 258 in chamber 302. At that point, only the fluid in the second pressure chamber 306 against the small area of the plunger end is opposing movement of the plunger 258.

The continued high pressure in the chamber 316 of course continues to cause high pressure in passages 382 and 384, causing continued displacement of piston 332, which in turn through the actuator 324 causes the valve 348 to remain in its open state.

After the fastener stem 396 has been pulled to a point where it is separated from the portions in the sleeve 397, just after the condition illustrated in FIG. 15, the pressure in the piston chamber 316 drops because of the absence of the load. This causes the pilot piston 331 to retract to the position of FIG. 11, but the liquid in the chamber 316 remains. The liquid in the piston chamber 316 may be manually vented to the reservoir in order that the drawbolt 252 may return to its original state, as shown in FIG. 14. To accomplish this, the relief valve 338 is opened by the plunger 364 being pressed inwardly. This enables fluid which is in the high-pressure chamber 316 to be relieved into the reservoir 234.

Figure 13:
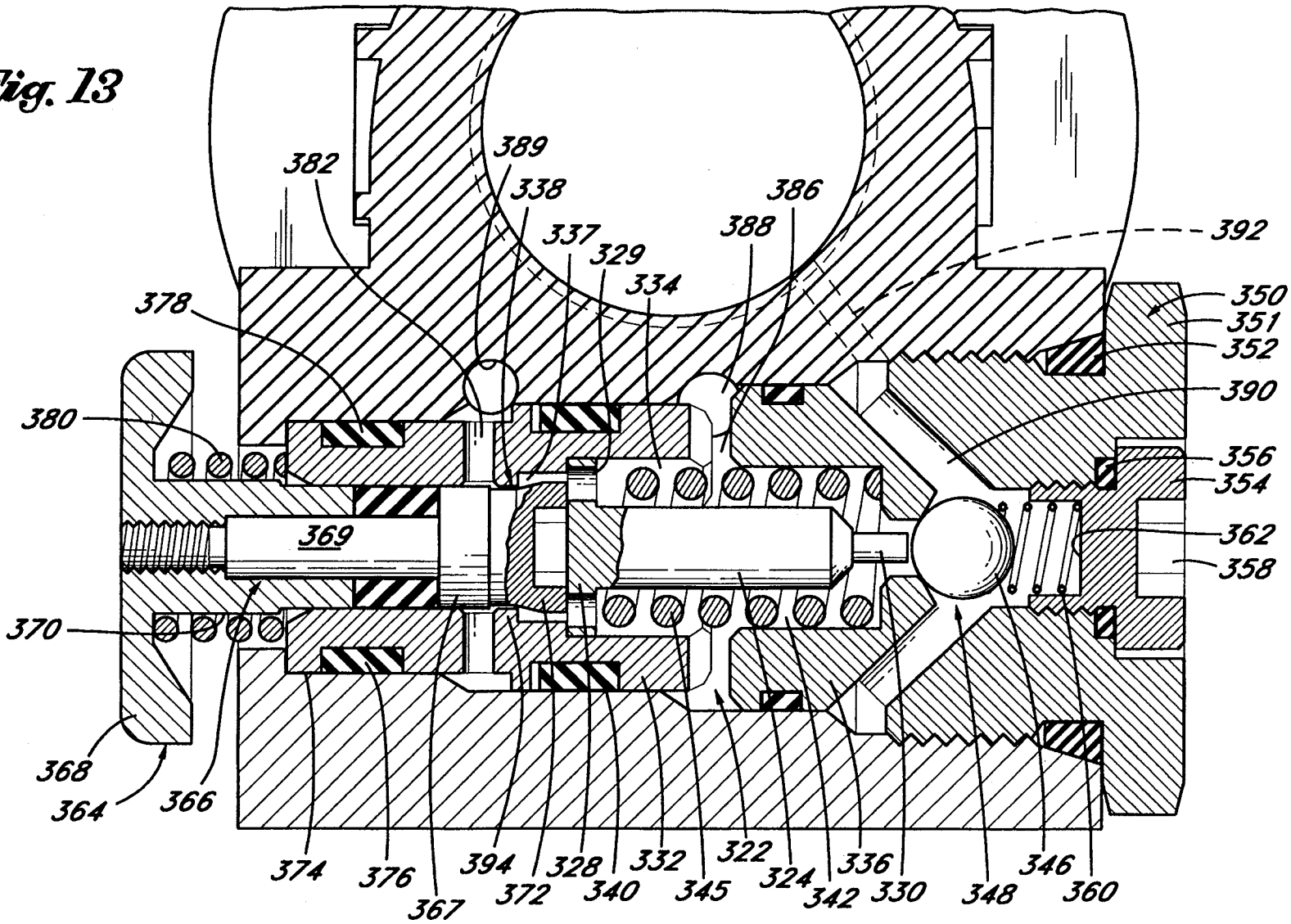

As illustrated in FIG. 13, when the plunger 364 is depressed, it opens a gap between the tapered valve member 372 and the valve seat 394 in the piston sleeve 332. At this time, the passages 382 and 386 become connected. Fluid then flows from the high-pressure chamber 316 to the passage 386, into the reservoir passage 388, and into the reservoir 234.

If the pressure generated in the chamber 316 increases to a predetermined maximum level, the high-pressure safety-relief feature of the tool functions. With high pressure in the chamber 316, the relief piston 332 will have been moved to open the bypass valve, as shown in FIG. 12. The high-pressure relief valve will remain closed until the pressure exceeds the maximum selected. As illustrated in FIG. 12, pressure in the high-pressure chamber 316 (on the order of 4000 pounds), which is connected to the passage 382 by passage 384, exerts pressure upon the very small area of the tapered valve member 372, which is effective to open it. That effective area is the difference in cross-sectional area between the valve stem section 367 and the cross-sectional area of the tapered section of the member 372 that engages the valve seat 394. Stated differently, the effective area is the difference in area between the sleeve bore portion surrounding the stem section 367 and the bore forming the valve seat 372. Note that the cylindrical stem section between the section 367 and the tapered section is reduced in diameter to allow adequate fluid flow. The maximum pressure necessary to open the relief system can thus be controlled by the diameter of the valve seat 397 and by the force of spring 380. The maximum pressure selected causes the valve member to move inwardly, opening a passage between the first chamber 382 and the second chamber 386, thus allowing fluid to drain to the reservoir 234 through the reservoir passage 388. When the relief valve first opens due to the maximum high pressure, the valve member 372 is spaced from the valve seat as shown in FIG. 13, but the piston 332 will still be in the depressed position of FIG. 12. Depending on the detail characteristics of the system, the relief valve may close as the pressure drops and the piston 332 may remain as shown in FIG. 12, or if the pressure drops sufficiently, the piston 332 may retract to the position shown in FIG. 13. Thus, although the relief valve can be easily manually opened by pressing the plunger knob 368, the normal operating pressure applied against the tapered valve member 372 cannot override the modest spring force of spring 380.

Although this invention has been described in terms of certain preferred embodiments, other embodiments that are apparent to those of ordinary skill in the art are also within the scope of this invention.

For example, while using a single plunger with two different pumping areas is the best mode currently contemplated, two separate plungers could be employed.

What is claimed is:

1. A hand-held tool for pulling a fastener stem while pushing against a fastener sleeve surrounding the stem to set the fastener in a workpiece, said tool comprising:

means for gripping and pulling said stem;

means for pushing against said sleeve while said stem is pulled;

a fluid reservoir;

a hand-operated hydraulic pump having a low pressure mode of operation wherein a manually actuated element provides a first fluid output with a given actuation of said element, to provide pressurized fluid connected to cause said pulling means to pull said stem relative to said pushing means, said pump having a high pressure mode of operation wherein the pump provides a reduced fluid output at a higher pressure than in said low pressure mode; and means for converting said pump from said low pressure mode to said high pressure mode during the setting of said fastener by returning a bypass portion of said output to said reservoir at a predetermined pressure so that higher output pressure can be generated with a reduced output utilizing a given manual force on said element.

2. The tool of claim 1, wherein said converting means includes means responsive to a predetermined pressure to automatically convert said pump from the low pressure mode to the high pressure mode.

3. The tool of claim 2, including a chamber for receiving the pressurized fluid from said pump, said chamber being connected to cause said pulling means to pull said stem relative to said pushing means, and said converting means being connected to sense the pressure in said chamber to trigger the converting to said high pressure mode.

4. The tool of claim 3, wherein said means responsive to said predetermined pressure is constructed to automatically convert the pump from the high pressure mode to the low pressure mode when the chamber pressure drops below said predetermined pressure.

5. The tool of claim 1, including a bypass passage connecting said portion of the pressurized fluid output from said pump to said reservoir, wherein said converting means is connected to prevent the pump output from flowing to said reservoir during said low pressure mode.

6. The tool of claim 1, wherein said pump includes a handle and said element comprises a manually actuated handle lever, and manual force required to move said lever increases as the pressure increases.

7. The tool of claim 1, including a housing and a piston in said housing slidably mounted with respect to said housing, and a pressure chamber formed in said housing adjacent said piston so that changes in the volume of said chamber produce relative movement of said piston and said housing, said piston and said housing being connected to said pulling means and said pushing means in a manner to cause said pulling means to pull said stem relative to said pushing means.

8. A hand-held tool for pulling a fastener stem while pushing against a fastener sleeve surrounding the stem to set the fastener in a workpiece, said tool comprising:

means for gripping and pulling said stem;

means for pushing against said sleeve while said stem is pulled;

a housing and a piston in said housing slidably mounted with respect to said housing, and a pressure chamber formed in said housing adjacent said piston so that changes in the volume of said chamber produce relative movement of said piston and said housing, said piston and said housing being connected to said pulling means and said pushing means in a manner to cause said pulling means to pull said stem relative to said pushing means;

a hand-operated hydraulic pump including first and second pump chambers connected to compress fluid into said piston chamber; and means for bypassing the output from said first pump chamber to a reservoir in response to a predetermined pressure in said piston chamber.

9. The tool of claim 8, wherein said bypass means includes a spring loaded valve which opens to bypass fluid from said first pump chamber to the reservoir when the pressure in said piston chamber reaches the predetermined level.

10. The tool of claim 8, wherein said bypass means comprises a bypass piston controlling flow from said first pump chamber to said reservoir, biasing means for biasing said bypass piston into a position preventing fluid flow from said first pump chamber to said reservoir but said piston being movable to a position in response to a predetermined pressure that permits flow from said first pump chamber to said reservoir.

11. A hand-held tool for pulling a fastener stem while pushing against a fastener sleeve surrounding the stem to set the fastener in a workpiece, said tool comprising:

means for gripping and pulling said stem;

means for pushing against said sleeve while said stem is pulled;

a hand-operated hydraulic pump having a low pressure mode of operation to provide pressurized fluid connected to cause said pulling means to pull said stem relative to said pushing means, said pump having a high pressure mode of operation wherein the pump provides fluid at a higher pressure than in said low pressure mode, but at a volume rate lower than in said low pressure mode;

means for converting said pump from said low pressure mode to said high pressure mode during the setting of said fastener; and wherein said tool includes a housing and said pump includes a plunger slidably mounted in said housing, a handle lever movable by finger pressure to produce said pressurized fluid, said plunger having an annular shoulder movable in a first pump pressure chamber in said housing and an end portion having a diameter smaller than the outside diameter of said plunger shoulder, said end portion being slidable in a second pump pressure chamber in said housing, a check valve permitting pressurized fluid to flow from said pump chambers into said piston chamber while preventing flow from said piston chamber into said pump chambers, a fluid reservoir in said tool, a passage connecting said first pump chamber to said reservoir, said converting means including a valve controlling the flow through said passage, said valve being responsive to the pressure in said piston chamber to prevent flow through said passage during said low mode operation whereby fluid from both the pump pressure chambers is compressed into said piston chamber, and said valve being openable in response to a predetermined pressure in said piston chamber to thereby convert the valve to its high pressure mode wherein the pressurized fluid output from said first pump chamber is compressed into said piston chamber while the output from said second pump chamber is bypassed to said reservoir.

12. A hand-held tool for pulling a fastener stem while pushing against a fastener sleeve surrounding the stem to set the fastener in a workpiece, said tool comprising:

means for gripping and pulling said stem;

means for pushing against said sleeve while said stem is pulled;

a hand-operated hydraulic pump having a low pressure mode of operation to provide pressurized fluid connected to cause said pulling means to pull said stem relative to said pushing means, said pump having a high pressure mode of operation wherein the pump provides fluid at a higher pressure than in said low pressure mode, but at a volume rate lower than in said low pressure mode;

means for converting said pump from said low pressure mode to said high pressure mode during the setting of said fastener; and a reservoir connected by a passage to said pump, a check valve in said passage oriented so that liquid can flow from the reservoir in response to sufficient pressure reduction in the pump but liquid cannot normally flow through the valve to the reservoir in response to liquid pressure in the pump, said converting means includes a pilot piston movable in response to a predetermined pump pressure and connected to open said check valve to allow a portion of the pump output to flow through said passage back to said reservoir.

13. The tool of claim 12, including a relief valve within said pilot piston for permitting said pressurized fluid to return to said reservoir, said relief valve being openable in response to a predetermined maximum pressure of said fluid.

14. The tool of claim 13, including a manually operable element for opening said relief valve.

15. A hand-operated hydraulic tool for setting a fastener having a stem to be pulled into a sleeve to form a head on the end of the sleeve, the tool having a housing with a piston slidable therein, a sleeve engaging anvil connected to the piston, stem gripping jaws, a fluid reservoir and a hand pump for compressing fluid from the reservoir against said piston, the tool further including:

a main piston pressure chamber for receiving pressurized fluid generated by said pump and causing movement of said piston with respect to said housing;

first and second pressure chambers for compressing fluid into said piston pressure chamber; and a bypass for bypassing fluid in the first pressure chamber to said reservoir in response to the fluid pressure in said piston pressure chamber reaching a predetermined level.

16. The tool of claim 15, wherein said bypass comprises a bypass piston slidably located in said housing, a first passage connecting said piston chamber to an internal end of said bypass piston, and a second passage connecting said first pump chamber to the reservoir, means for biasing said bypass piston into a position obstructing said second passage, said bypass piston being movable to an open position allowing fluid to flow through said second passageway in response to a predetermined pressure in said piston chamber acting on said bypass piston.

17. The tool of claim 16, wherein said bypass piston is mounted transversely to said main piston and to the rear of said main piston.

18. The tool of claim 15, wherein said bypass comprises a bypass piston slidably positioned in said housing, a passage connecting said pump piston chamber to an internal end of said bypass piston, a second passage connecting said first pump chamber to the reservoir, a normally closed valve in said second passage, a spring biasing said bypass piston into a position wherein it does not affect said normally closed valve, said bypass piston being movable into position to cause said normally closed valve to be opened in response to a predetermined pressure in said piston chamber acting on said bypass piston.

19. The tool of claim 18, including a normally closed relief valve positioned within said bypass piston for connecting said first passage to said second passage, said relief valve being openable in response to a predetermined maximum pressure in said main piston pressure chamber.

20. The tool of claim 19, wherein said relief valve includes a valve seat formed on an internal portion of said piston and a valve member connected to a manually operated stem for manually opening said relief valve to allow the liquid in said main piston chamber to return to said reservoir.

21. A hand-operated hydraulic tool for use in setting fasteners having a stem and a sleeve, the tool having a housing with a piston slidable therein, sleeve engaging means, stem gripping means, a fluid reservoir and a pump for compressing fluid drawn from the reservoir, the tool further including:

first and second areas with which said pump presses upon the fluid;

a chamber into which fluid compressed by said pump with said first and second areas is delivered in a manner to cause relative movement between the piston and the housing to pull the stem with respect to the sleeve; and means for bypassing fluid from said first area to the reservoir, whereby the pump only presses upon fluid in said second area so as to deliver fluid to said chamber after the fluid pressure in said chamber reaches a predetermined level.

22. The tool of claim 21, further including means for releasing said fluid in said chamber to the reservoir, including a passage connecting said chamber to the reservoir, and a manually operated relief piston located in said passage in a manner that said relief piston obstructs said passage in a closed position, and when engaged, allows fluid to move freely through said passage in an open position.

23. The tool of claim 22, wherein said pump has a handle and a lever pivotally mounted on the handle to manually operate said pump, said relief piston extending rearwardly from said housing generally parallel to a pump plunger and close to said lever to be conveniently actuated.

24. A hand-operated hydraulic tool for use in setting fasteners having a stem and a sleeve, said tool comprising a piston movable within a housing having a centerline, a nosepiece for pushing on said sleeve and jaws for pulling on said stem, said tool further including:

a first pump chamber;

a second pump chamber;

a piston chamber;

a plunger for pressing fluid located in the first and second pump chambers into said piston chamber; and means for bypassing output from said first pump chamber into the reservoir when the fluid pressure in said piston chamber exceeds a predetermined pressure, whereby fluid is compressed into said piston chamber by said plunger in only said second pump chamber.

25. The tool of claim 24, further including automatic means within said bypassing means for relieving the fluid pressure in said piston chamber to the reservoir when said pressure becomes excessive.

26. The tool of claim 24, wherein said means for bypassing includes a bypass passage connecting said first pump chamber to said reservoir, a passage connecting said piston chamber to a bypass piston slidably mounted along a second centerline within said housing which runs transverse to the housing centerline, biasing means biasing said bypass piston in a manner in which it blocks said passage connecting said first pump chamber to said reservoir until fluid pressure from said piston chamber exceeds the closing pressure of said biasing means.

27. The tool of claim 26, further including a passage located within said bypass piston connecting said bypass passage to the reservoir, and a check valve located along said relief passage and on said second centerline so as to allow fluid to pass from said piston chamber to the reservoir when pressure in said piston chamber becomes excessive.

28. The tool of claim 24, including a passage connecting said first pump chamber to said reservoir, said bypassing means including a bore extending through said housing along a second centerline which extends transverse to the housing centerline, a plug in one end of said bore containing a check valve, said passage opening into said bore, and said check valve being positioned within said plug and being oriented to permit flow from the reservoir to said first pump chamber in response to pressure reduction in said first pump chamber, while preventing flow from said first pump chamber into said reservoir in response to pressure increases in said first pump chamber, a bypass piston slidably mounted in said bore, said bypass piston including an end surface connected by a second passage to said piston chamber, a valve actuator extending between said bypass piston and said plug, a strong coil spring extending between said plug and a flange on said valve actuator, urging said valve actuator and said piston away from said plug, said bypass piston being movable in response to said predetermined pressure to move against the urging of said spring causing an end of said valve actuator to open said bypass valve to allow fluid in said first pump chamber to flow back into said reservoir.

29. The tool of claim 28, including a relief valve in said pilot piston, said relief valve including a valve seat formed on said bypass piston and a plunger extending axially out of said bypass piston and out through the end of said bore opposite from said plug, a spring urging said plunger in relief valve closing direction, said relief valve being responsive to a predetermined maximum pressure in said piston chamber so as to move into an open position in opposition to said plunger spring to allow liquid to flow from said piston chamber to said reservoir, said relief valve being manually movable by said release valve plunger to allow liquid in said piston chamber to return to said reservoir.

30. A hand-operated hydraulic tool for setting fasteners having a stem and sleeve, comprising:

a housing;

a tubular piston slidably mounted in said housing;

a nosepiece connected on one end of said piston;

a drawbolt extending through said piston and fixed to said housing with the piston being slidable on the drawbolt;

stem gripping jaws connected to a forward end of said drawbolt;

a plunger slidably mounted in a tubular rear portion of said drawbolt and in a rear portion of said housing;

a reservoir containing fluid;

a first plunger chamber surrounded by a portion of said drawbolt;

a second plunger chamber located between an inner end of said plunger and an interior rear portion of said drawbolt;

a piston pressure chamber surrounding said drawbolt in communication with the rear of said piston;

one or more check valves connecting said plunger pressure chambers with said piston chamber;

a handle lever for reciprocating said plunger to compress fluid from said reservoir in said first and second plunger chambers and past said check valves into said piston chamber; and a bypass valve connected to render said first plunger chamber ineffective to compress fluid into said piston chamber with said plunger when the pressure in said piston chamber reaches a predetermined level.

31. A compact hand-operated hydraulic fastener setting tool for use in setting fasteners having a stem and sleeve, the tool comprising:

a housing having a longitudinal axis;

a handle located on said housing having a reservoir therein;

a piston slidably mounted within said housing along said axis;

a hand-operated plunger;

first and second pump areas on said plunger for compressing fluid into a pressure chamber reacting against said piston;

means for bypassing fluid from said first pump area to the reservoir, said bypass means located in said housing below said axis and along a second centerline running transverse to said housing axis and to the rear of said axis.

32. A method of setting a fastener having a stem in a sleeve with a hand operated fastener setting tool, comprising:

compressing hydraulic fluid with a hand-operated pump in a low pressure mode of operation to provide pressurized fluid connected to cause said stem to be pulled relative to said sleeve; and converting said pump to a high pressure mode of operation by bypassing a portion of the pump fluid a to a fluid reservoir so that a reduced pump volume is obtained for a given manual actuation of the pump, and less force is required for said actuation, whereby higher pressure may be generated with a given manual force.

33. The method of claim 32, wherein said converting step is performed automatically at a predetermined pressure required to pull said stem relative to said sleeve.

34. The method of claim 32, wherein said converting step is performed when the finger force required to compress said fluid with the hand-operated pump becomes relatively high, whereas in said high pressure mode the force required to operate said hand-operated pump is initially lower than that in said low pressure mode, but yet continues to increase as the pressure for pulling said stem increases.

35. The method of claim 32, wherein said compressing step in said low pressure mode includes compressing fluid in first and second pump pressure chambers, and the compressing step in the high pressure mode includes compressing fluid in only one of said pump pressure chambers such that the effort required to compress the fluid is reduced but a higher pressure can be obtained with a given manual pumping force than can be obtained in the low pressure mode.

36. A method of setting a fastener having a stem and sleeve with a hand-operated fastener setting tool having a housing and a piston movable therein, sleeve engaging means, stem gripping means, plunger, and fluid in a fluid reservoir, comprising:

reciprocating the plunger to compress fluid in first and second pump chambers;

delivering fluid from said first and second pump chambers to a piston pressure chamber exposed to said piston;

causing relative movement of the piston with respect to the housing to pull said stem using the fluid pressure in said piston pressure chamber;

bypassing said first pump chamber so as to reduce the force needed to manipulate said plunger; and continuing to provide pressurized fluid to said piston chamber utilizing only said second pump chamber so as to pull said stem until the fastener is set.

37. The method of claim 36, wherein said compressing step includes compressing the fluid with first and second areas of said plunger, and compressing said fluid with the plunger in a second stage with only the second area of said plunger.

38. The method of claim 36, including:

placing the sleeve engaging means against the sleeve of the fastener;

gripping the stem of the fastener with the stem gripping means, said gripping means being connected to a drawbolt and said drawbolt being connected to said housing; and allowing the fluid in said piston chamber to force the housing, and the drawbolt and stem, away from said piston and sleeve.

39. The method of claim 36, including reciprocating said plunger into said first and second chambers, which are located in a tubular rear portion of a drawbolt connected to said stem gripping means, said delivering step including forcing fluid from said pump chambers through check valves into said piston pressure chamber which surrounds a portion of said drawbolt and said bypassing step includes applying the pressure of said piston chamber to the end of a bypass piston extending to the rear of and transverse to said piston chamber, said bypass piston controlling flow from said fluid pump chamber to said reservoir in response to the pressure in said piston chamber.

* * * * *